US007594375B2

(12) United States Patent
Dussault

(10) Patent No.: US 7,594,375 B2
(45) Date of Patent: Sep. 29, 2009

(54) APPARATUS FOR BAGGING MATERIAL

(76) Inventor: Jacques Dussault, 3, rue Belcourt, Beaumont, Quebec (CA) G0R 1C0

( * ) Notice: Subject to any disclaimer, the term of this patent is extended or adjusted under 35 U.S.C. 154(b) by 0 days.

(21) Appl. No.: 11/690,009

(22) Filed: Mar. 22, 2007

(65) Prior Publication Data

US 2007/0220832 A1 Sep. 27, 2007

Related U.S. Application Data

(60) Provisional application No. 60/784,487, filed on Mar. 22, 2006, provisional application No. 60/834,793, filed on Aug. 2, 2006.

(51) Int. Cl.
*B65B 53/00* (2006.01)
*B65B 43/04* (2006.01)
*B65B 43/30* (2006.01)

(52) U.S. Cl. ..... 53/556; 53/562; 53/567; 53/570; 53/384.1

(58) Field of Classification Search ..... 53/556, 53/567, 570, 562, 384.1
See application file for complete search history.

(56) References Cited

U.S. PATENT DOCUMENTS 3,621,638 A * 11/1971 Grocke ..... 53/386.1
3,707,064 A * 12/1972 Mucka et al. ..... 53/567
3,735,557 A * 5/1973 Hoffarth et al. ..... 53/567
3,738,079 A * 6/1973 Rudman et al. ..... 53/66
3,778,960 A * 12/1973 Christensen et al. ..... 53/459
3,961,459 A * 6/1976 Wolske ..... 53/436
4,050,219 A * 9/1977 Higgins ..... 53/567
4,063,401 A * 12/1977 Higgins ..... 53/567
4,064,678 A * 12/1977 Grocke ..... 53/567
4,473,990 A * 10/1984 Thimon ..... 53/567
4,546,598 A * 10/1985 Karpisek ..... 53/556
4,698,951 A * 10/1987 Everman et al. ..... 53/449
4,724,658 A * 2/1988 Birkenfeld et al. ..... 53/557
5,142,841 A * 9/1992 Cappi et al. ..... 53/384.1
6,032,439 A 3/2000 Birkenfeld et al.
6,298,636 B1 * 10/2001 Lachenmeier et al. ..... 53/442
6,381,929 B1 * 5/2002 Chen ..... 53/567
6,662,535 B2 12/2003 Pin
6,722,103 B2 4/2004 Gambetti
6,904,736 B2 6/2005 Drolet (Continued)

FOREIGN PATENT DOCUMENTS

DE 3908957 A1 * 9/1990

(Continued)

*Primary Examiner*—Stephen F Gerrity
(74) *Attorney, Agent, or Firm*—Ladas & Parry LLP

(57) ABSTRACT

An apparatus for bagging material into a film. The film has at least two overlapping sheets and at least one open edge. The apparatus has a pair of spaced apart carriages and a pair of clamp assemblies movably mounted to a respective carriage. The clamp assemblies are pivotally movable relative to the respective carriage and vertically moveable along the length of the respective carriage. The clamp assemblies engage the film and open the film by separating the overlapping sheets. The clamp assemblies are moved downwardly along the length of the respective carriages so as to provide for the opened film to progressively bag material positioned thereunder. The clamp assembly includes a clamp having a pair of clamping members which are configured to grip a portion of the overlapping sheets for separation thereof. A method for bagging material into a film is also disclosed.

30 Claims, 22 Drawing Sheets

U.S. PATENT DOCUMENTS

| | | | | |
|---|---|---|---|---|
| 6,925,778 | B2 | 8/2005 | Suolahti | |
| 6,978,587 | B2 | 12/2005 | Drolet | |
| 7,114,311 | B2 | 10/2006 | Drolet | |
| 7,114,313 | B2 | 10/2006 | Drolet | |
| 2002/0170270 | A1* | 11/2002 | Borchard | 53/432 |
| 2007/0051075 | A1* | 3/2007 | Chiu Chen | 53/504 |

FOREIGN PATENT DOCUMENTS

| | | | |
|---|---|---|---|
| JP | 01240425 | A * | 9/1989 |

* cited by examiner

APPARATUS FOR BAGGING MATERIAL

CROSS-REFERENCE TO RELATED APPLICATIONS

The present application request priority on U.S. provisional application Ser. No. 60/784,487 filed on Mar. 22, 2006 as well as U.S. provisional application 60/834,793 filed on Aug. 2, 2006 both of which are incorporated herein by reference in their entirety.

FIELD OF THE INVENTION

The present invention relates to bagging material. More specifically, the present invention is concerned with an apparatus and method for bagging material.

BACKGROUND OF THE INVENTION

It is known in the art to bag, package, cover or wrap certain products, such as bundles of lumber, in order to protect them from the external environment, such as UV radiation, and preserve an appropriate degree of humidity. Apparatuses for loading forestry, agriculture or other products into stretchable plastic tubes or films have been provided. Traditional systems can be labor intensive at the mill site, and can also result in the ingress of moisture through rips and perforations. Therefore some later improvements in bagging such goods provided apparatuses having a support board with a stretch film and moveable fingers in horizontal and vertical directions for picking up this film and covering the stack or bundle of products.

U.S. Pat. No. 6,032,439 issued to Birkenfeld et al, on Mar. 7, 2000 teaches an apparatus for covering articles on a support palet with a stretch film. The apparatus includes at least four reefing fingers that are movable in the horizontal and vertical directions for picking up the film in four corners and covering the rectangular bundle.

U.S. Pat. No. 6,662,535 issued to Pin on Dec. 16, 2003 teaches an apparatus for bagging material into a stretchable bag having an open end. This apparatus includes a movable bag stretching structure movable between a first position for receiving the bag and a second position for holding the bag in a stretched state. The apparatus further includes bag gripping members for turning the bag inside out over the movable bag stretching structure. The movable bag stretching structure is displaced towards a facing side of the material while being held in a stretched state. This continuous displacement causes the bag to be inverted onto the material for covering thereof.

U.S. Pat. No. 6,978,587 issued to Drolet on Dec. 27, 2005 provides an apparatus and a method for the automated wrapping of a bundle with a resilient stretchable film. This patent teaches an apparatus and method which provides for unrolling a desired length of film and cutting this desired length. The film includes two overlapping panels. The edges of the open side are grasped and opened and the opened tube is loaded onto an expandable frame. At least a portion of the tube is accumulated on this expandable frame in a folded condition. The expandable frame then stretched the tube and the bundle of material is then covered by this tube made of film.

The cited references above are incorporated herein by reference.

A drawback of the above systems is that they are relatively expensive and require a lot of space to be installed. A drawback of the known systems is that they are inconvenient.

OBJECTS OF THE INVENTION

An object of the present invention is to provide an apparatus for bagging material.

An object of the present invention is to provide a method for bagging material.

SUMMARY OF THE INVENTION

In accordance with an aspect of the present invention, there is provided an apparatus for bagging material into a film, the film having at least two overlapping sheets and at least one open edge, the apparatus comprising: a pair of spaced apart carriages; and a pair of clamp assemblies, each clamp assembly being movably mounted to a respective carriage so as to be pivotally movable relative to the respective carriage and vertically moveable along the length of the respective carriage, wherein the clamp assemblies engage the film and are configured to open the film by separating the overlapping sheets, the clamp assemblies being downwardly movable along the length of the respective carriages so as to provide for the opened film to progressively bag material positioned thereunder.

In accordance with another aspect of the present invention, there is provided an apparatus for bagging material into a film, the film having at least two overlapping sheets and at least one open edge, the apparatus comprising: a pair of spaced apart carriages; and a pair of clamp assemblies, each clamp assembly being mounted to a respective carriage and comprising a respective clamp, each clamp comprising a respective pair of clamping members being reciprocally movable from a clamping position for engaging the film to an unclamping position, each clamping member comprising respective gripping elements for gripping a sheet of the film, wherein when the clamping members engage the film from the external surface thereof, each clamping member of a given clamp engages a respective overlapping sheet, the gripping elements of each said clamping member grip a portion of a respective sheet, the clamping elements of each given clamp are moved in the unclamping position thereby separating the sheets from one another.

In accordance with a further aspect of the present invention, there is provided a method for bagging material into a stretchable film, the method comprising: providing a desired length of stretchable film, the film having at least two overlapping sheets and at least one open edge; stretching the desired length of film by clamping the film on the outer surface thereof at two opposite areas, each area being near a respective longitudinal length of the film and moving the two clamped areas away from one another; separating the two overlapping sheets by gripping an outer portion of each sheet and moving these gripped outer portions away from one another thereby opening the film; and covering the material by progressively moving the film onto the material while maintaining the gripped outer portions.

It should be noted that the terms "bagging", "covering", "wrapping" and like terms with reference to a film on material or bundle of material are interchangeable and replaceable by like terms within the context of the present invention.

Other objects, advantages and features of the present invention will become more apparent upon reading of the following non-restrictive description of illustrative embodiments thereof, given by way of example only with reference to the accompanying drawings.

BRIEF DESCRIPTION OF THE DRAWINGS

In the appended drawings, where like reference numerals denote like elements throughout, and where.

DETAILED DESCRIPTION OF ILLUSTRATIVE EMBODIMENTS

Figure 1:
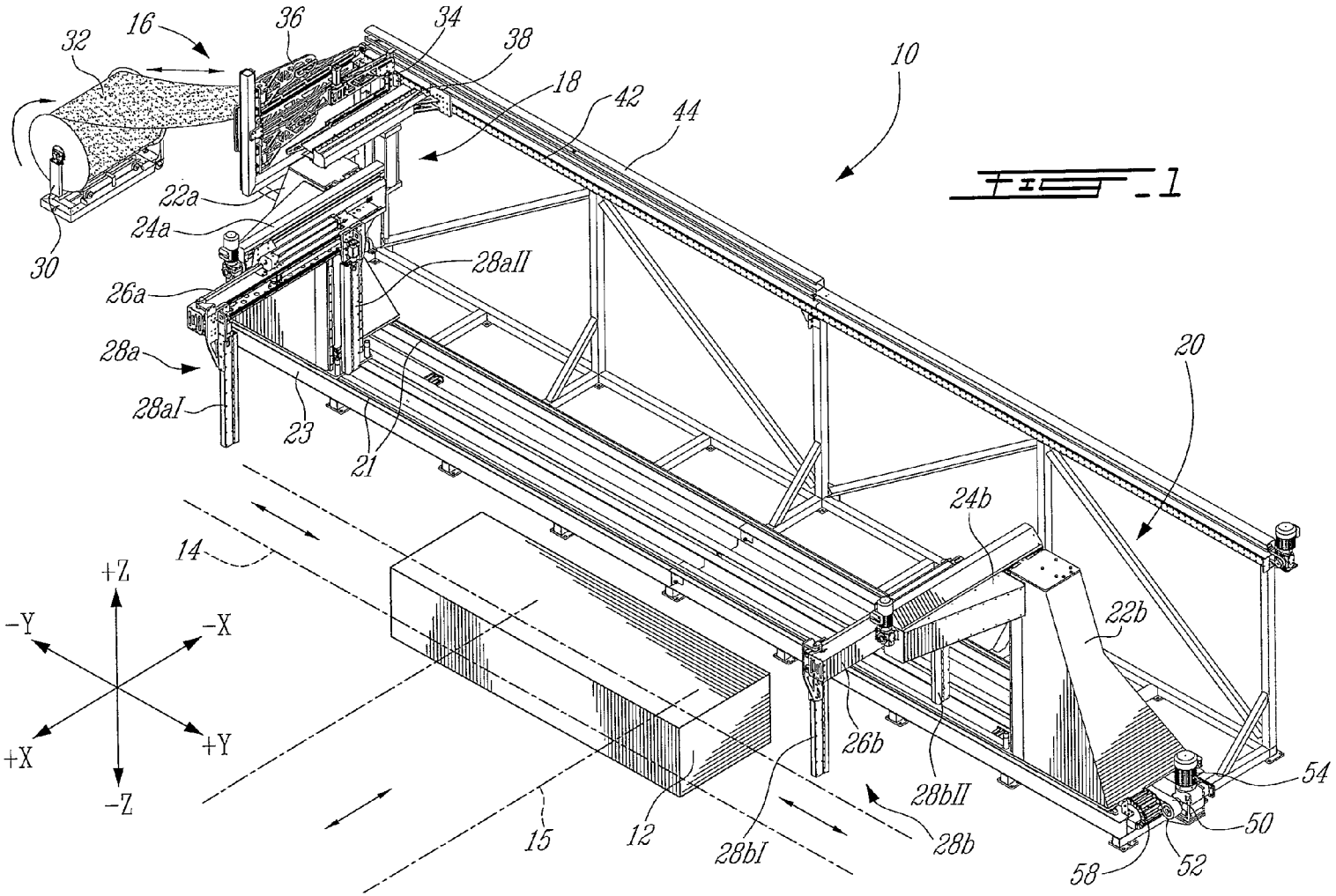
FIGS. 1-9 are top perspective sequential views of the apparatus for bagging material in accordance with an illustrative embodiment of the present invention.

Generally, stated the invention provides an apparatus for bagging material into a stretchable film that comprises a pair of moveable carriages including respective clamps. Each clamp is movably mounted to a respective carriage so as to be elevated or descended along the vertical length of the carriage, transversely moved in the left and right direction relative to the carriage and rotated from a generally horizontal position to a generally vertical position. The carriages are transversely movable relative to one another so as to bring the clamps closer together or move them further apart. A bagging film is positioned adjacent to the carriages, the distance between the carriages will depend on the length of the film that is to be used to bag material. The film is folded thereby defining two overlapping sheets with the closed edge facing the carriages and the opposite edge being open. The clamps, of each carriage, respectively clamp an opposite longitudinal end of the film from the external side of the film and move the film above the material that is to be bagged. The carriages move away from each other causing the clamps to stretch the film and then the carriages may be brought closer to one another after the film has been sufficiently stretched. Each clamp comprises a pair of clamping members, each clamping member engages a sheet. The clamping members move away from one another thereby pulling each respectively engaged sheet away from the other thus opening the film. Maintaining the foregoing position, the clamping members then descend the open film onto the material, with the open side facing the material, causing the film to progressively cover this material during descent. When the material is covered, the clamping members disengage the sheets.

With reference to the associated drawings embodiments of the present invention will now be described.

In order to facilitate the present description, direction arrows in the Y, X and Z axis are represented in the drawings so as assist in describing the movement of the various parts of the present invention.

Sequential FIGS. 1-9 show an apparatus 10 for bagging material in a bundle such as a load 12 of lumber (not shown) for example.

The apparatus 10 is an assembly of sub-apparatuses including a first load transfer 14 for conveying the load 12 in the −Y and +Y directions, a second load transfer 15 for conveying the load 12 in the +X and −X directions, a film dispensing and cutting assembly 16, a film conveying device 18 for conveying film in the −Y and +Y directions, and a film stretching and bagging device 20. The first and second load transfers 14 and 15 may be in-feed or out-feed transfers and are known in the art and need not be described or illustrated in further detail.

The stretching and bagging device 20 includes a pair of left and right moveable columns or carriages 22*a* and 22*b* movably mounted on rails 21 formed on a base frame 23 and being adjacent to the load transfers 14 and 15. Carriages 22*a* and 22*b* are transversely movable on a rail 21 in the −Y and +Y directions.

Each left and right moveable carriages 22*a* and 22*b* includes a respective elevator support 24*a* and 24*b* movably mounted thereto. The elevator supports 24*a* and 24*b* are respectively moveable along the carriages 22*a* and 22*b* in the −Z and +Z directions.

Each elevator support 24*a* and 24*b* supports a respective mobile arm 26*a* and 26*b* moveably mounted thereon. The mobile arms 26*a* and 26*b* are respectively moveable along supports 24*a* and 24*b* in the −X and +X directions and also respectively rotatable on supports 24*a* and 24*b* as shown by arrow R in FIGS. 11 and 12 from a generally horizontal position to a generally vertical position respectively and vice versa.

Each mobile arm 26*a* and 26*b* includes a respective clamp 28*a* and 28*b*. With reference to FIGS. 1, 2, 9, and 10-12, each clamp 28*a* and 28*b* includes respective pair of clamping members 28*a*I, 28*a*II and 28*b*I, 28*b*II. Clamping members 28*a*I and 28*a*II are oppositely moveable in relation to one another along the support 24*a* in the +X and −X directions. Clamping members 28*b*I and 28*b*II are oppositely moveable in relation to one another along the support 24*b* in the +X and −X directions. Thereby, the clamps 28*a* and 28*b* are moveable from an unclamping (open) position shown in FIG. 10 to a clamping (closed) position shown in FIG. 11.

With reference to FIG. 1, the film dispensing and cutting assembly 16 includes a film dispenser 30, for carrying a film 32 in a roll, as well as a sealing and cutting unit 34 which may include a film holder 36 for receiving the film 32 from dispenser 30, cutting a predetermined amount film 32 and then sealing this film in a desired arrangement as is known in the art.

The film conveying device 18 includes a leading lateral clamp 38 and a floating clamp 40 moveably mounted to a rail 42 along the lateral frame 44 and actuated by motor 46 so as to move in the −Y and +Y directions. As better shown in FIGS. 6, 7 and 8, the lateral clamp 38 includes gripping members 39 for gripping a free end of the film 32. As better shown in FIGS. 6, 7 and 8, the floating clamp 40 includes clamping members 41*a* and 41*b* moveably mounted on base member 43 so as to move in the +Z and −Z directions. The base member 43 is in turn movably mounted on the rail 42.

With particular reference to FIGS. 1, 3, 13 and 14 each carriage 22*a* and 22*b* includes bearings 48 on its underside 49 that are slidably mounted along the rails 21. With reference to FIGS. 1-9, the carriages 22*a* and 22*b* are movable along rails 21 by way of a displacement belt 50 mounted to a rotating actuator 52 and powered by a motor and gearbox assembly 54, the belt 50 is mounted to a pulley 53 at the opposite end of the base frame 23 in relation to actuator 52. The carriages 22*a* and 22*b* are mounted to the belt 50 via a fastening assembly 56 (see FIGS. 15 and 15). The longitudinal ends of the base frame 23 include bumpers 58 for stopping the transversal movement of the carriages 22*a* and 22*b*.

With reference to FIGS. 11, 12, 15 and 16, the front faces of the carriages 22*a* and 22*b* include vertical rails 60 (only carriage 22*a* is shown but it should be understood that carriages 22*a* and 22*b* are substantially identical).

Figure 15:
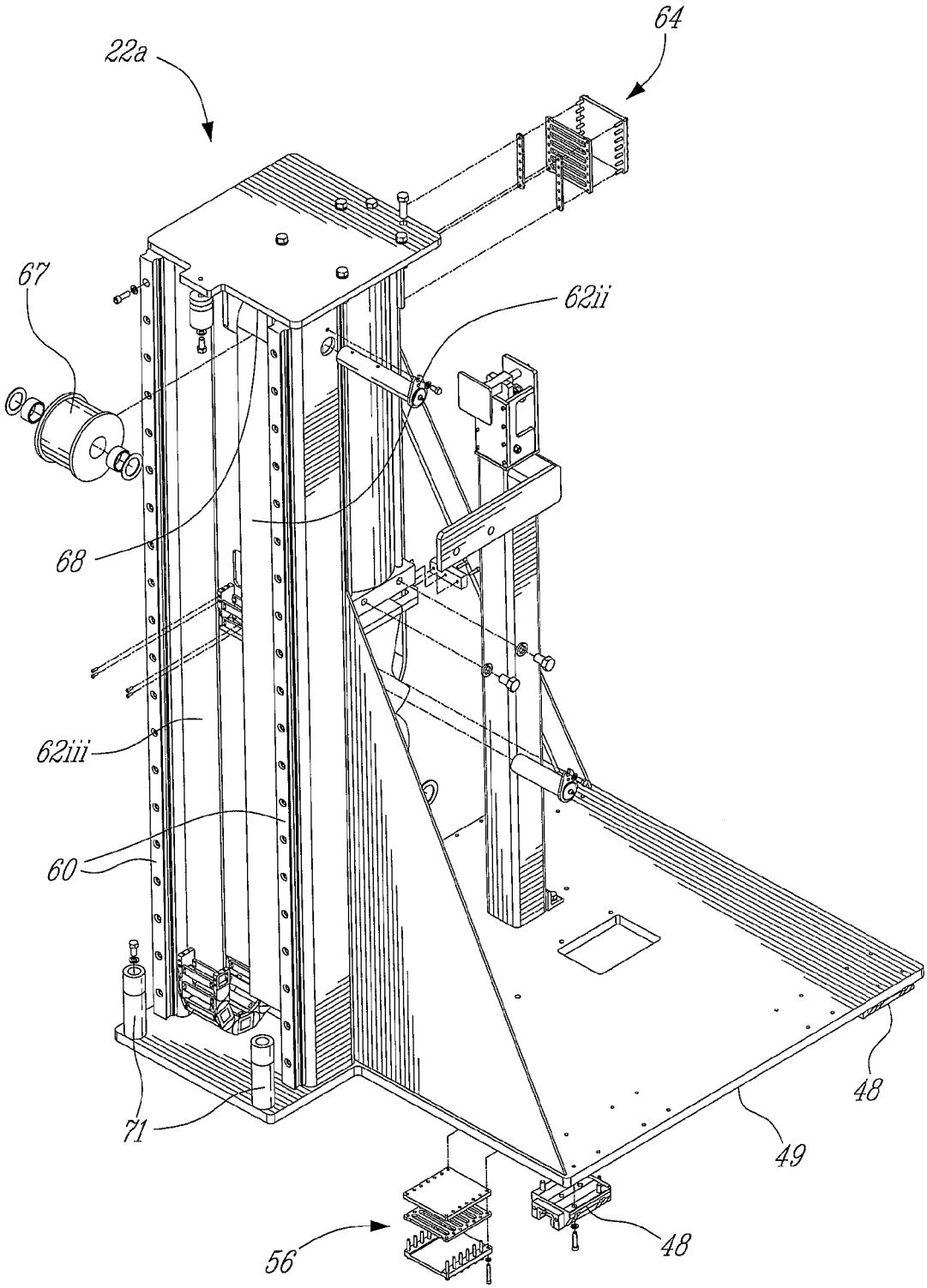
FIG. 15 is a perspective front partially exploded view of a carriage in accordance with the an illustrative embodiment of the present invention.
Figure 16:
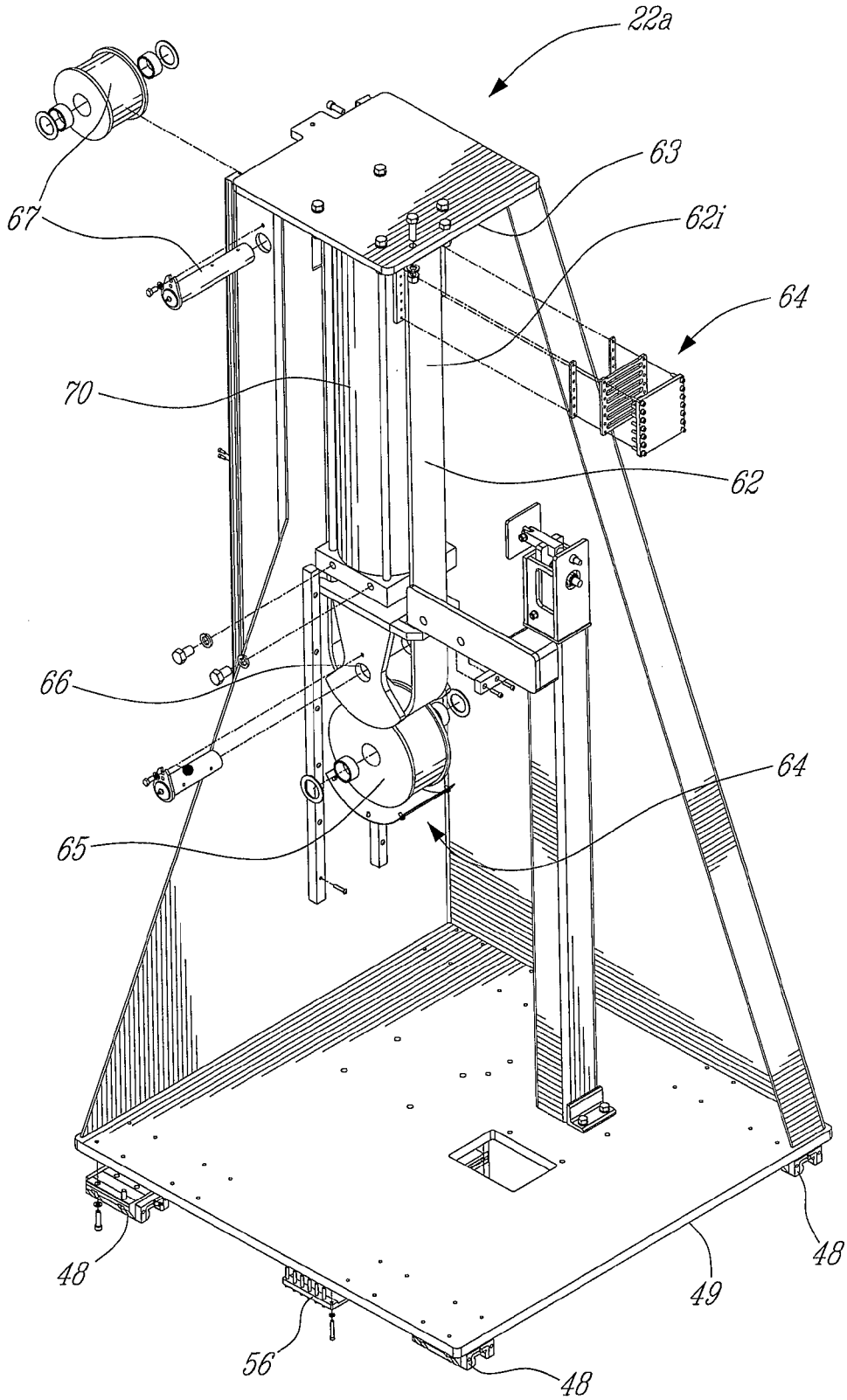
FIG. 16 is a perspective rear partially exploded view of the carriage of FIG. 15.

With reference to FIGS. 15 and 16, the rails 60 which provide the elevator supports 24*a* and 24*b* to move thereon in the −Z and +Z directions by way of an actuator assembly 61 mounted within each carriage 22*a* and 22*b*. The actuator assembly 61 includes a conveyor belt 62 fixedly mounted at one end to the inner rear top end 63 of a carriage 22*a* and 22*b* via a fastening assembly 64. The belt 62 engages a first pulley 65 roatably mounted within a moveable housing 66 and a second pulley 67 roatably mounted near the inner front top end 68 of a carriage 22*a* and 22*b*. In this way, the belt 62 defines three zones, a first zone 62*i* between the fastening assembly 64 and pulley 65, a second zone 62*ii* between pulley 65 and pulley 67 and third zone 62*iii* between pulley 67 and an elevator support 24*a* and 24*b*.

Turning to FIG. 15, an elevator support 24*a* (the following applies to actuator 24*b* as well) is mounted to the belt zone 62*iii* of a carriage 22*a* (or 22*b*) via a fastening assembly 68. The elevator supports 24*a* and 24*b* include four linear bearings 69 which slidably engage the vertical rails 60

Figure 11:
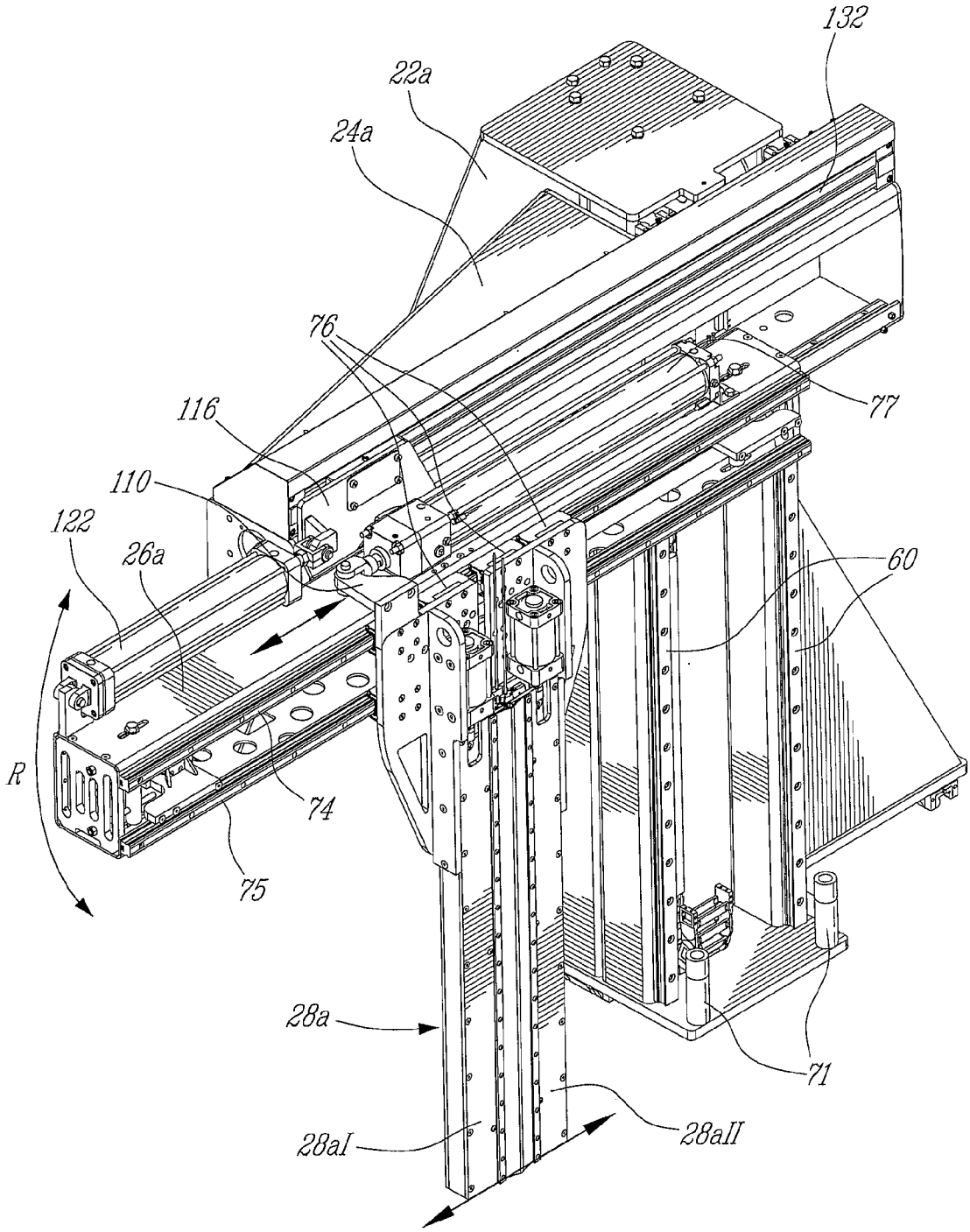
FIG. 11 is a perspective view of a clamp in an closed position mounted to an mobile arm in the horizontal position, which is mounted to an elevator support, which in turn is mounted to a carriage in accordance with an illustrative embodiment of the present invention.
Figure 12:
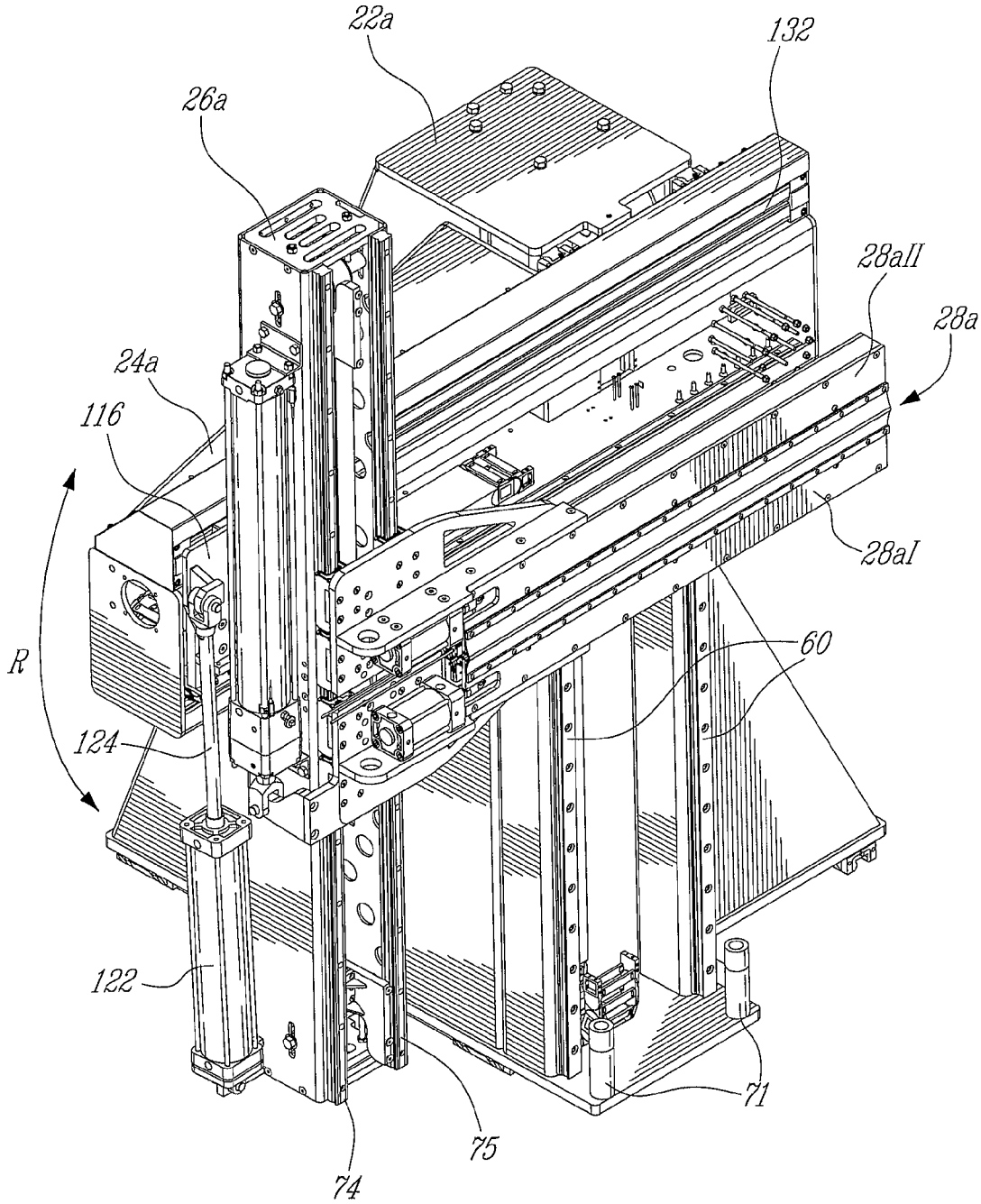
FIG. 12 is a perspective view of a clamp in an closed position mounted to an mobile arm in the vertical position, which is mounted to an elevator support, which in turn is mounted to a carriage in accordance with an illustrative embodiment of the present invention.

Returning to FIG. 16, an actuator 70 in the form of a pneumatic cylinder is mounted within the carriages 22*a* and 22*b* and is connected to the pulley housing 66 via a reciprocating rod (not shown). With reference to FIGS. 11, 12 and 15, the bottom end of the front face of each carriage 22*a* and 22*b* includes a pair of stoppers 71 for stopping the elevator supports 24*a* and 24*b* during their descent. A gore-track 72 is provided for wiring.

Therefore, when the cylinder 70 moves the pulley housing 66 downardly in the −Z direction, belt zone 62*iii* is pulled back raising the elevator support 24*a* or 24*b* in the +Z direction. When the cylinder 70 moves the housing 66 upwardly in the +Z direction, the belt 62 is provided with slack allowing belt zone 62*iii* to move forward thereby descending the elevator support 24*a* or 24*b* in the −Z direction.

Figure 10:
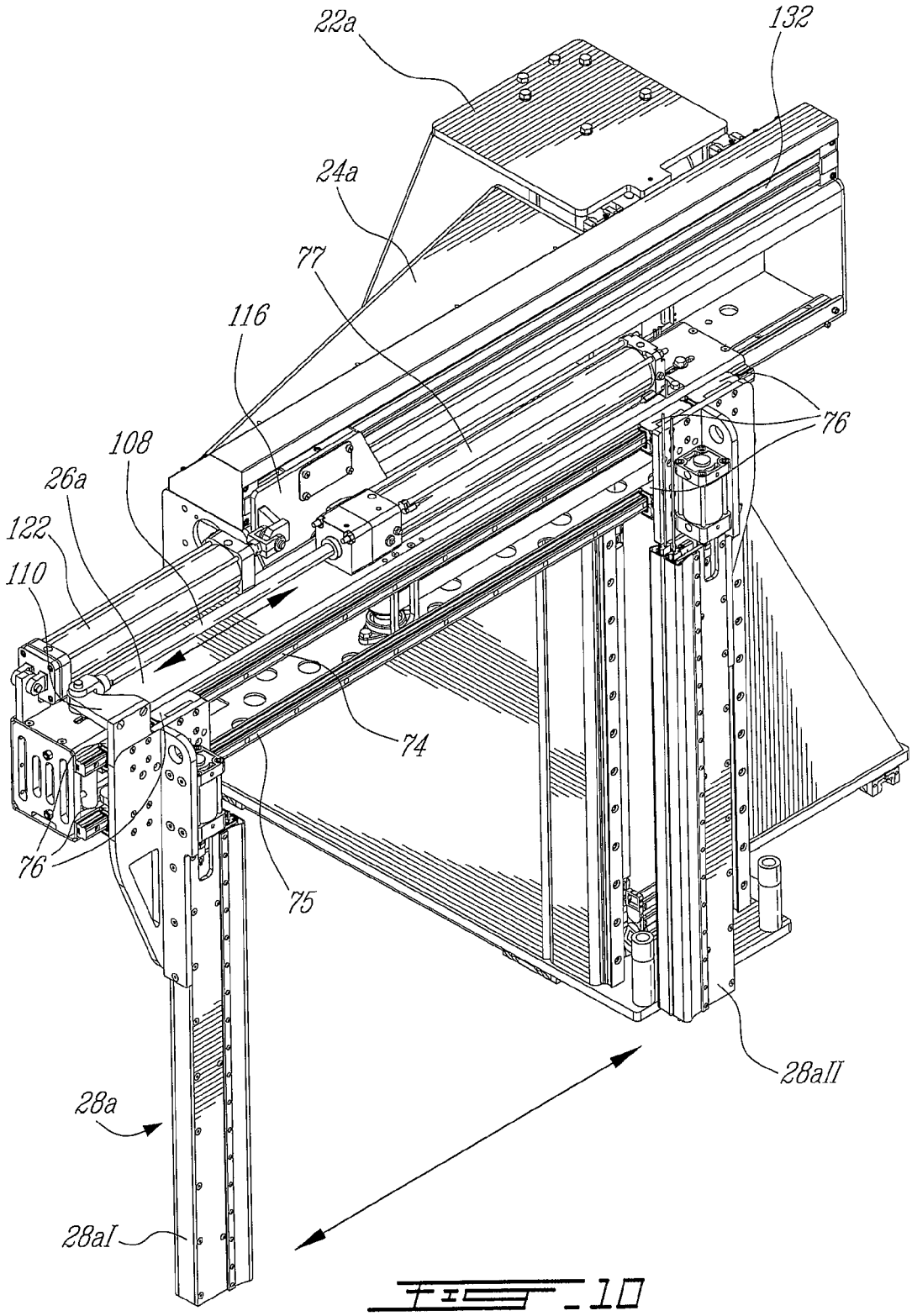
FIG. 10 is a perspective view of a clamp in an open position mounted to an mobile arm in the horizontal position, which is mounted to an elevator support, which in turn is mounted to a carriage in accordance with an illustrative embodiment of the present invention.
Figure 13:
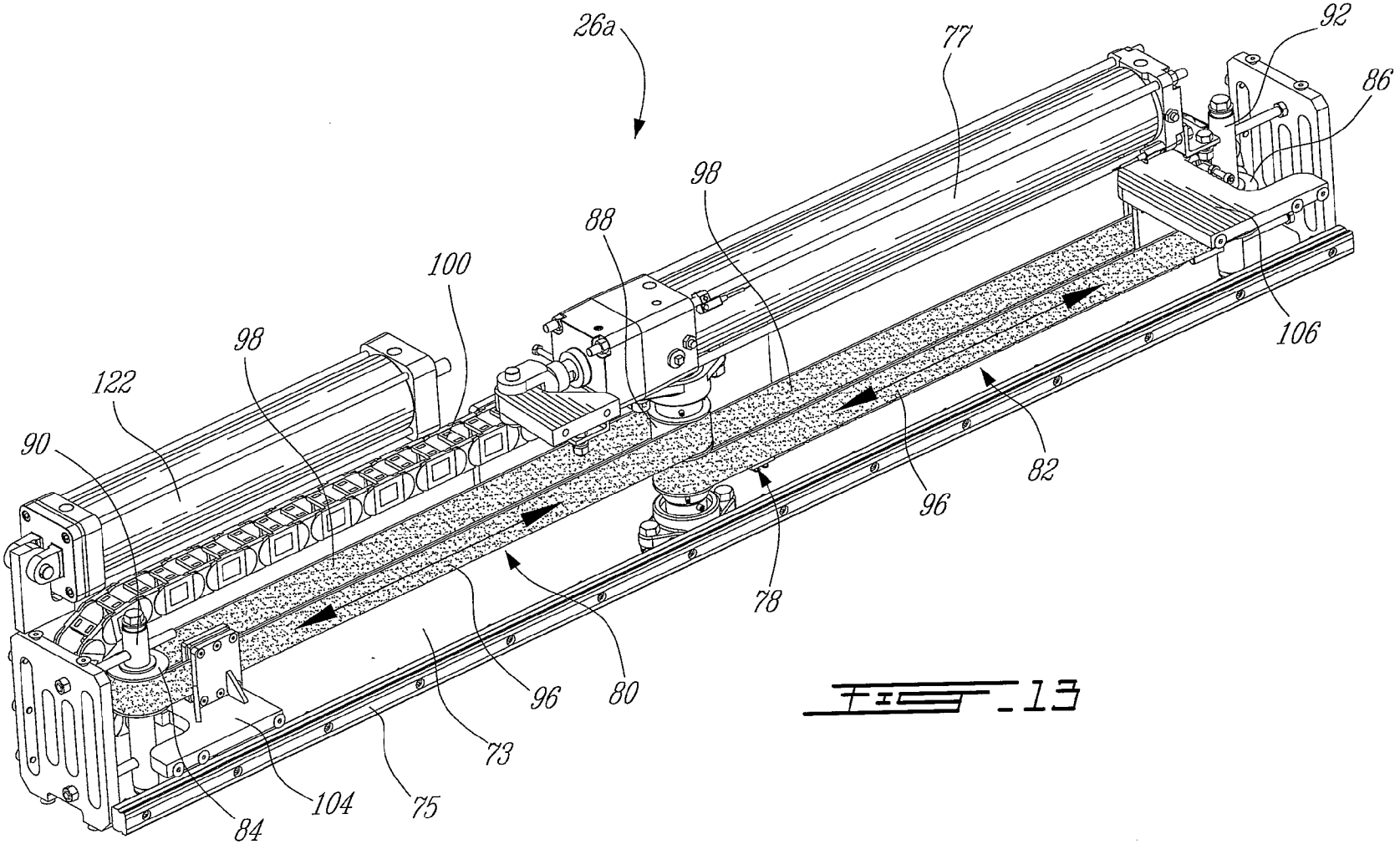
FIG. 13 is a perspective view of the mobile arm of in accordance with the an illustrative embodiment of the present invention.
Figure 14:
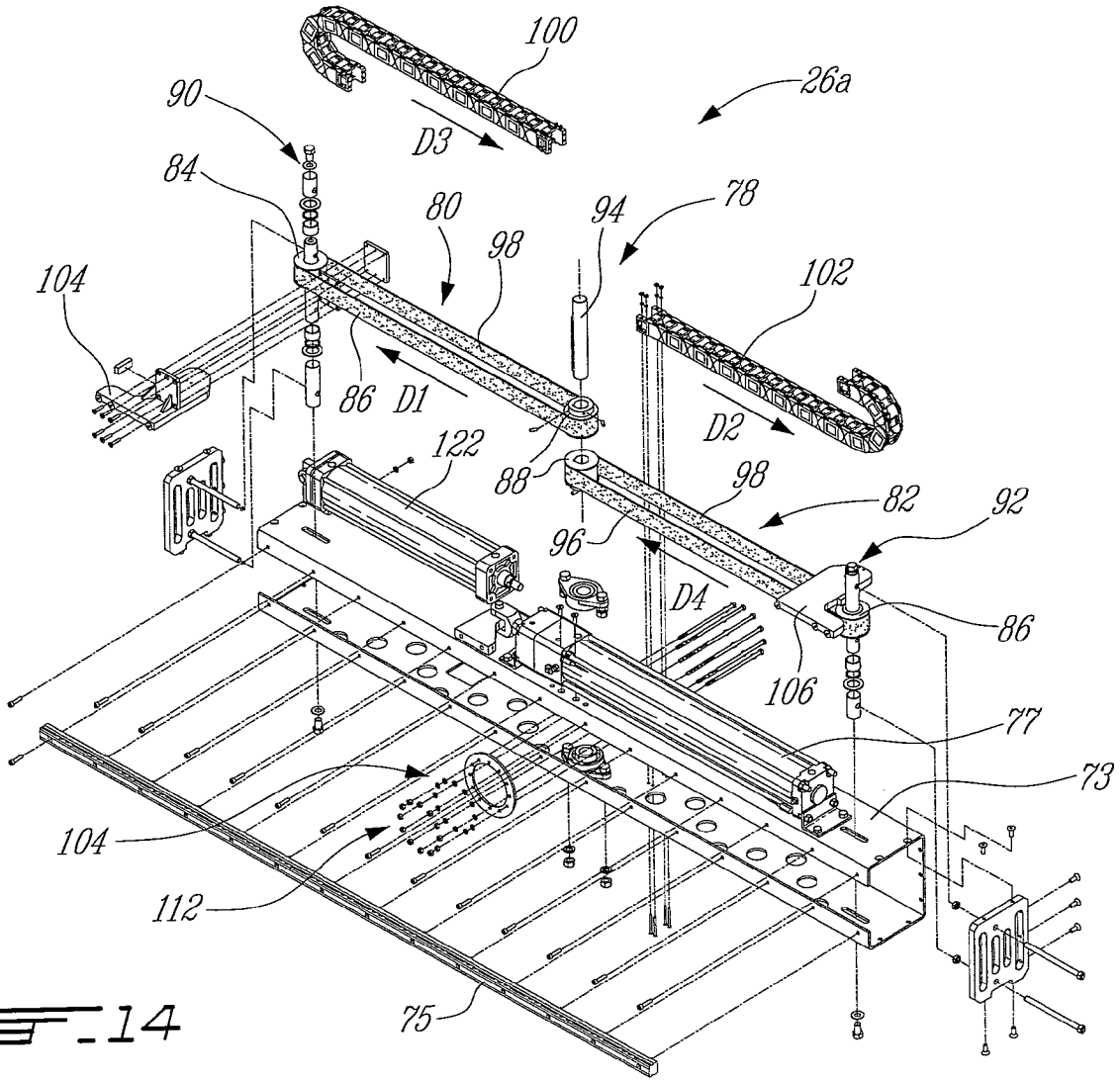
FIG. 14 is an exploded perspective view of the mobile arm of FIG. 13.

Now turning to FIGS. 13 and 14, each mobile arm 26*a* and 26*b* (only 26*a* is shown but arms 26*a* and 26*b* are substantially identical) includes a housing 73 a respective top rail 74 (see FIGS. 10 and 11) and a respective bottom rail 75 mounted on the front face of the housing 73 for movably mounting a respective pair of clamping members 28*a*I, 28*a*II and 28*b*I, 28*b*II via linear bearings 76 thereto (see FIGS. 10 and 11). The mobile arms 26*a* and 26*b* include a respective pneumatic actuator 77 mounted on the housing 73 for actuating a pulley assembly 78 mounted within the housing 73 and comprising a pair of gear belts 80 and 82. The gear belts 80 and 82 are mounted to respective lateral end pulley members 84 and 86 and a respective central pulley member 88. Each lateral end pulley member 84 and 86 receives a respective shaft assembly 90 and 92. Lateral end pulley members 84 and 86 are configured to respectively rotate about shaft assemblies 90 and 92. The central pulley members 88 are collinearly and rotatively mounted about a common shaft 94. The gear belts 80 and 82 are configured to rotate about the pulley members 84, 86 and 88 thus defining front and rear belt zones 96 and 98 respectively. Gore-tracks 100 and 102 provide for guiding any wiring during rotational movement of the gear belts 80 and 82.

A clamping member 28*a*I or 28*b*I is mounted to the pulley assembly 78 of a respective arm 26*a* and 26*b* via a link 104. A clamping member 28*a*II or 28*b*II is mounted to the pulley assembly 78 of a respective arm 26*a* and 26*b* via a link 106. Link 104 is mounted to the front zone 96 of gear belt 80 and link 106 is mounted to the rear zone 98 of gear belt 82.

With reference to FIG. 10, the pneumatic actuator 77 includes a reciprocating rod 108 mounted to the clamping member 28*a*I (and 28*b*I) via a connector 110.

When the pneumatic actuator 76 extends the rod 108, the rod 108 pushes the clamping member 28*a*I (and 28*b*I) in the +X direction. The clamping member 28*a*I (and 28*b*I) is mounted to the front zone 96 of gear belt 80 via link 104 and hence causes the front zone 96 of the gear belt 80 to move in the direction shown by D1 (see FIG. 14), the gear belt 80 acts on the pulley member 88 which causes gear belt 82 to rotate in tandem. The clamping member 28*a*II (and 28*b*II) is mounted to the rear zone 98 of gear belt 82 via link 106, the rear zone 98 of gear belt 80 moves in the direction shown by D2 which causes the clamping member 28*a*II (and 28*b*II) to move in the −X direction. Thereby causing the clamps 28*a* and 28*b* to open as shown in FIG. 10.

When the pneumatic actuator 77 retracts the rod 108, the rod 108 pulls the clamping member 28*a*I (and 28*b*I) in the −X direction. The clamping member 28*a*I (and 28*b*I) causes the gear belt 80 to move in the direction shown by D3 (see FIG. 4). The rear side 98 of gear belt 80 moves in the direction shown by D4 which causes the clamping member 28*a*II (and 28*b*II) to move in the +X direction. Thereby causing the clamps 28*a* and 28*b* to close as shown in FIG. 11.

Figure 17:
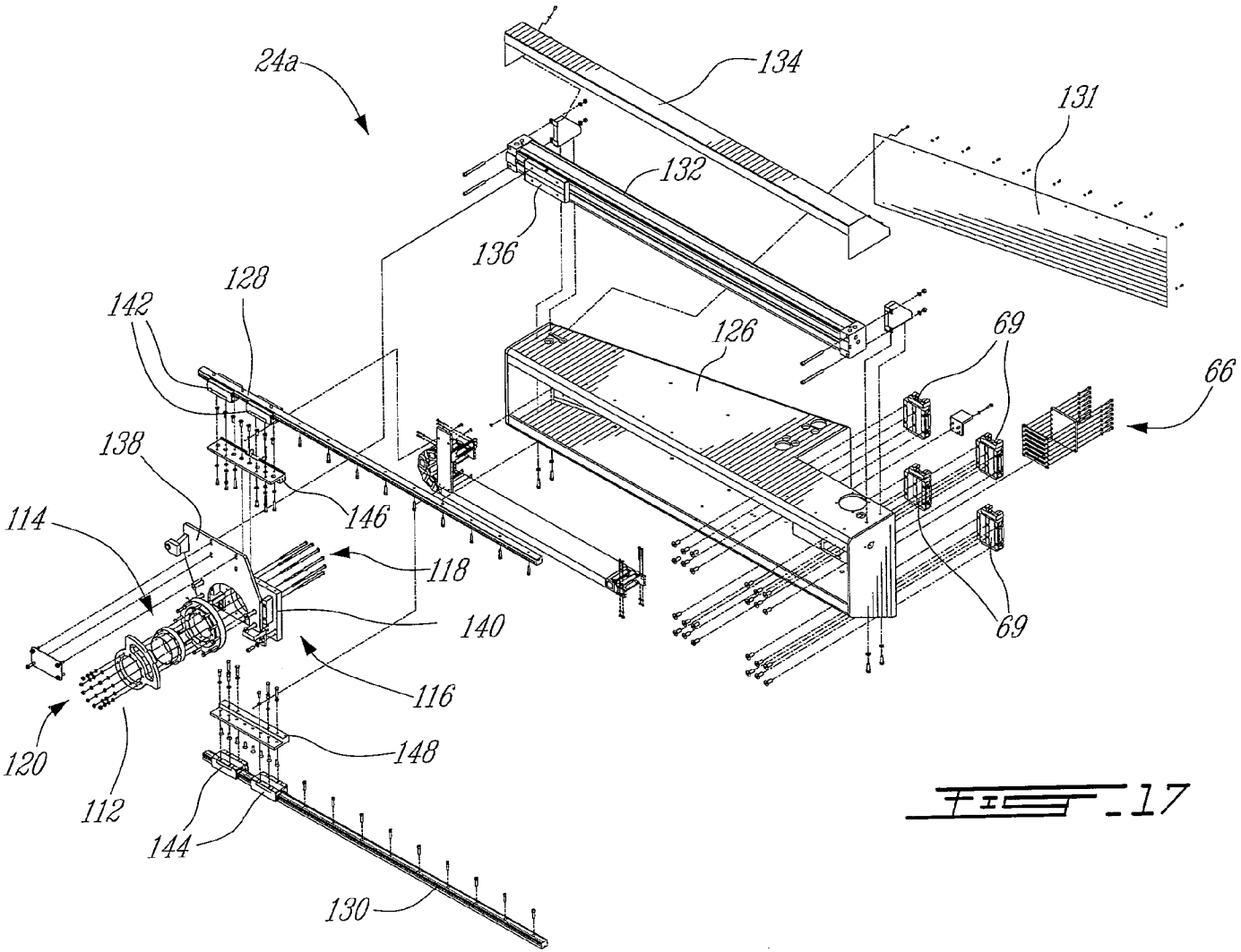
FIG. 17 is a perspective front exploded view of the elevator support in accordance with the an illustrative embodiment of the present invention.

With respect to FIGS. 11, 12, 14 and 17, the mobile arms 26*a* and 26*b* are pivotally mounted to their elevator supports 24*a* and 24*b* respectively via a respective pivot assembly 112. With reference to FIGS. 14 and 17 the pivot assembly 112 comprises a circular bearing assembly 114 mounted to a sliding plate 116 via bolts 118 and fasteners 120. The pivot assembly 112 thereby defines a pivot axis about which the arm 26*a* and 26 rotates in the R direction as shown in FIGS. 11 and 12. Each arm 26*a* and 26 includes a pneumatic actuator 122 in the form of a cylinder mounted on the housing 73 (see FIGS. 10-14). The cylinder 122 includes a reciprocating rod 124 (see FIG. 12) pivotally connected to the sliding plate 116.

When the cylinder 122 extends the rod 124 it causes the mobile arm 26*a* or 26*b* to rotate from the generally horizontal position to a vertical position about the pivot assembly 112. When the cylinder 122 retracts the rod 124 it causes the mobile arm 26*a* or 26*b* to rotate from the generally vertical position to the generally horizontal position.

With reference to FIG. 17, each elevator support 24*a* and 24*b* (24*a* is only shown but 24*b* is similarly constructed) includes a housing 126 for housing upper and bottom horizontal rails 128 and 130 respectively therein. The housing 126 includes a back panel 131. An actuator 132 such as a rodless pneumatic cylinder is mounted on the housing 132 and covered by cover 134. The cylinder 132 includes an actuating plaque 136, that moves in +X and −X directions along the length of the cylinder 132. The plaque 136 is mounted on the front larger portion 138 of the sliding plate 116. The rear smaller portion 140 of the sliding plate is mounted to upper linear bearings 142 and lower linear bearings 144 via upper and lower connectors 146 and 148 respectively. In this way. The cylinder 132 moves the plaque 136 in the +X and −X directions causing the plaque 136 to move the sliding plate 116 therewith, the sliding plate sliding moving along the which sliding moves along the upper and bottom horizontal rails 128 and 130 and moving the mobile arm 26*a* or 26*b* therewith.

Figure 18A:
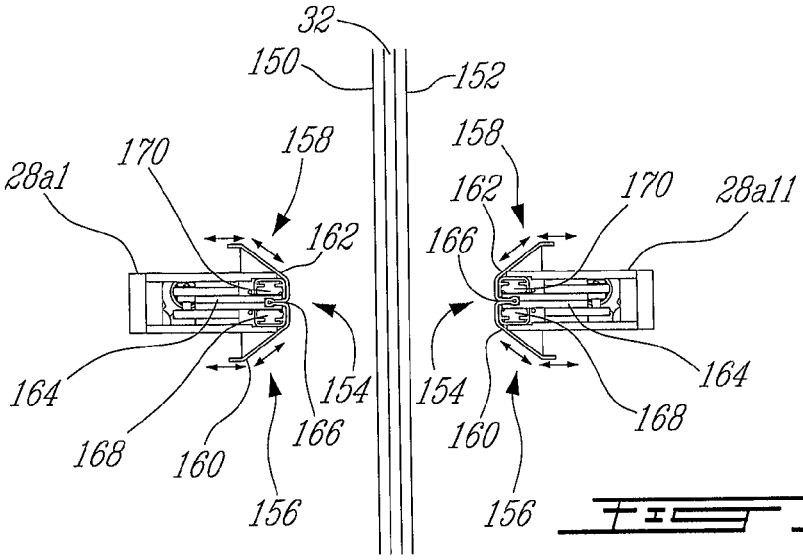
FIGS. 18A-18E are sequential partial front views of the clamping members acting on a film in accordance with the an illustrative embodiment of the present invention.
Figure 18B:
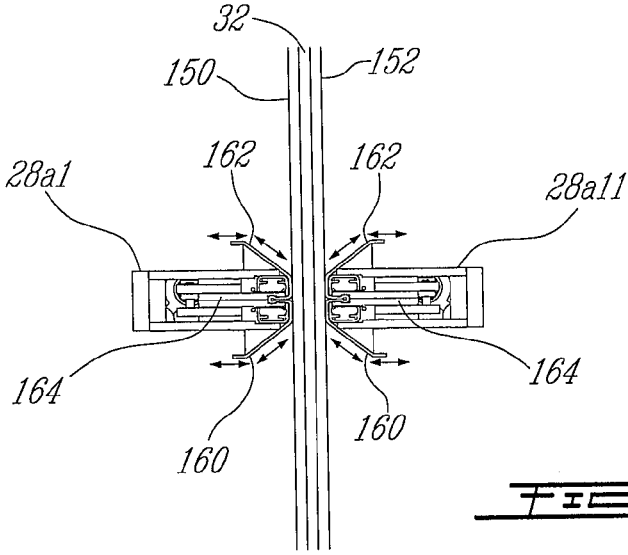
Figure 18C:
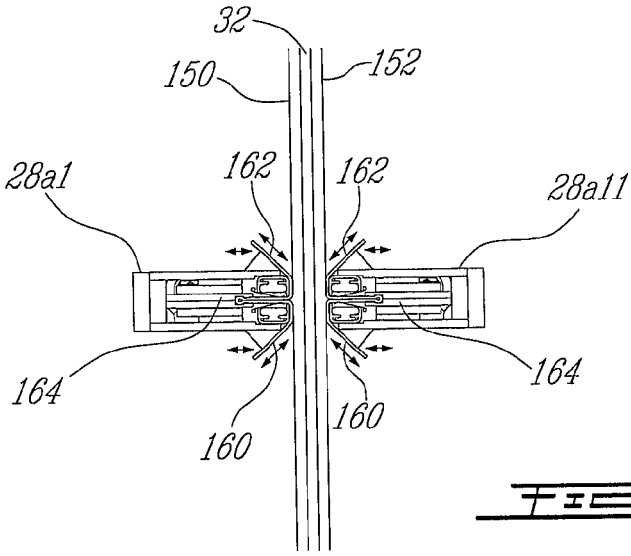
Figure 18D:
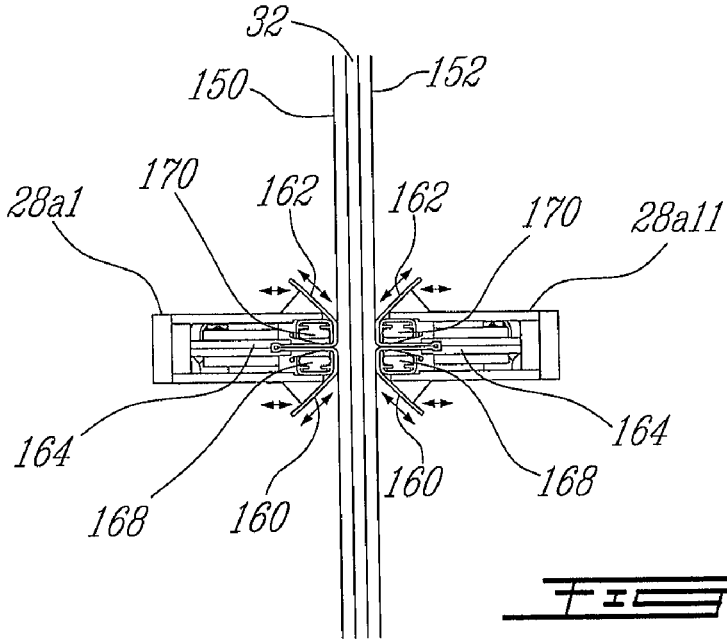
Figure 18E:
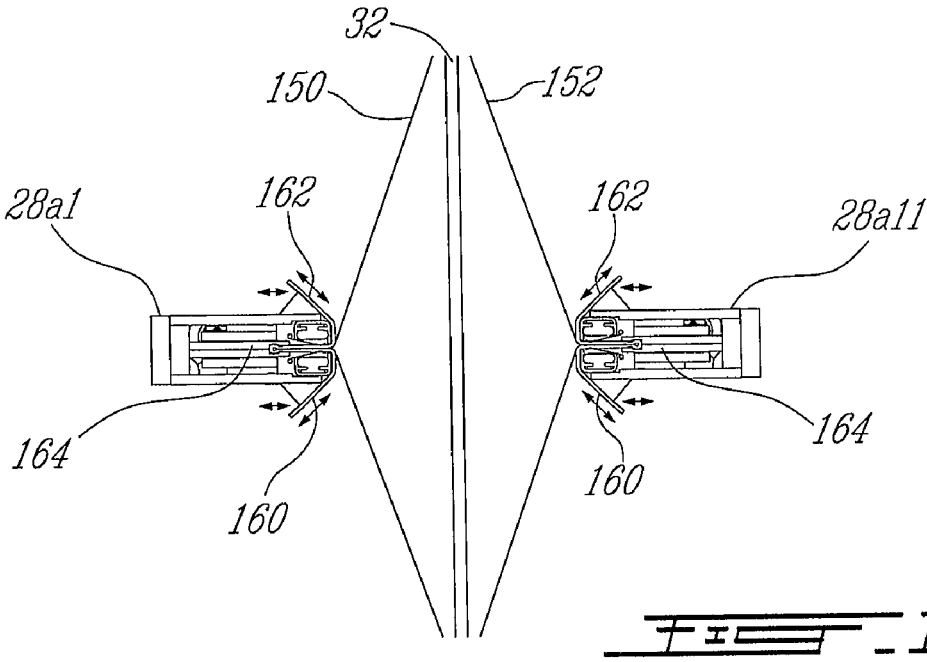
Figure 19A:
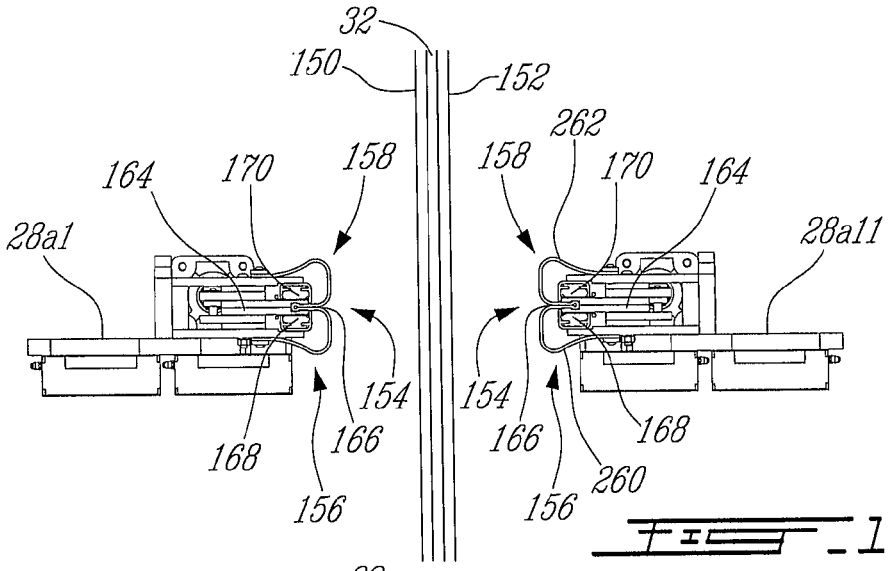
FIGS. 19A-19E are sequential partial front views of the clamping members acting on a film in accordance with the another illustrative embodiment of the present invention.
Figure 19B:
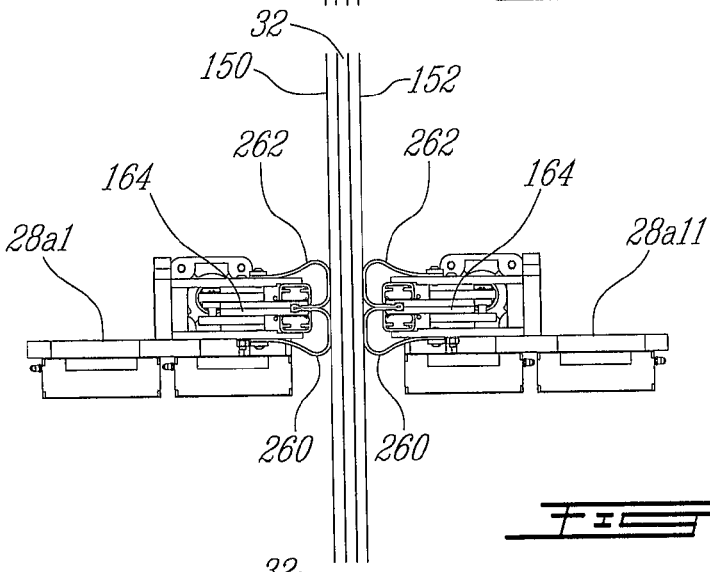
Figure 19C:
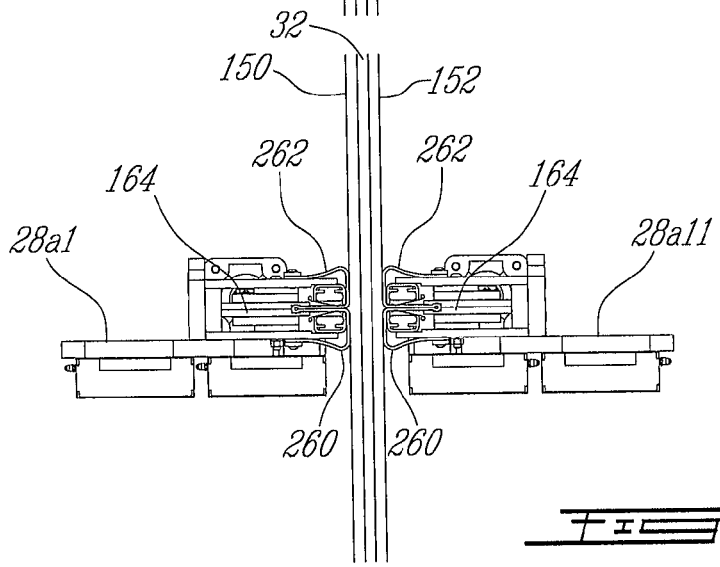
Figure 19D:
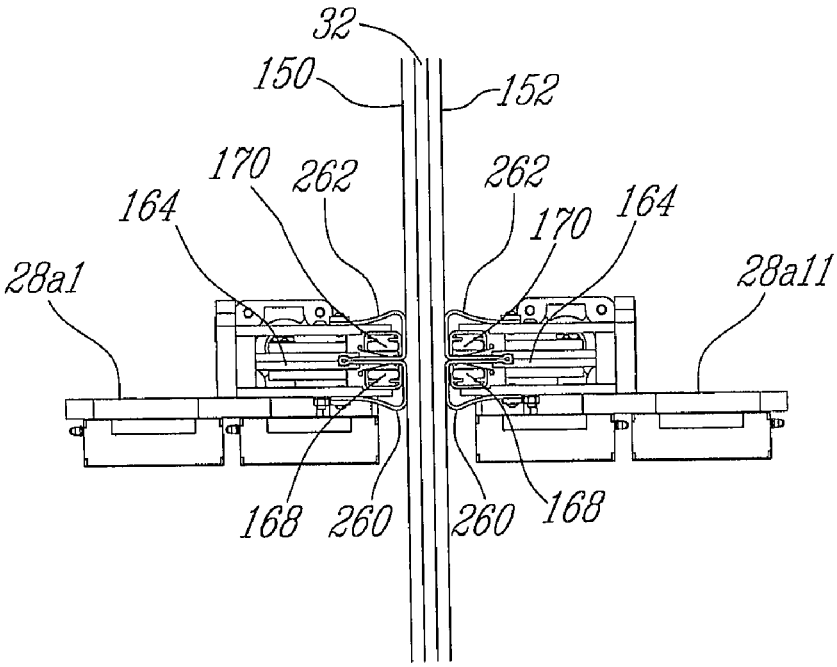
Figure 19E:
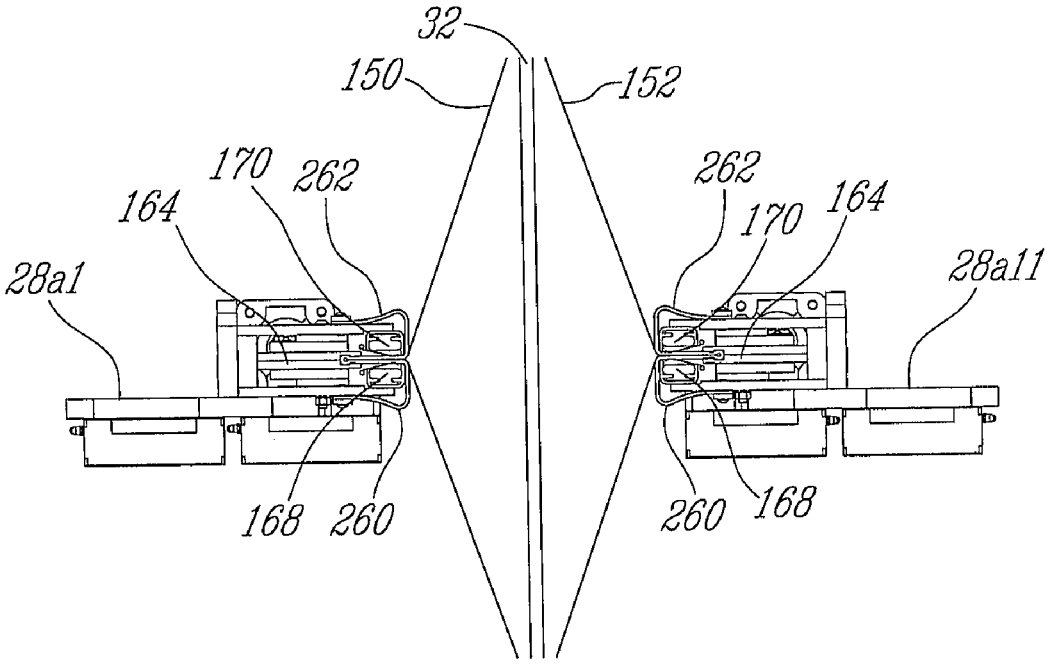

As mentioned above each clamp 28*a* and 28*b* comprises a respective pair of clamping members 28*a*I, 28*a*II and 28*b*I and 28*b*II. With reference to FIGS. 18A-18E, the clamping member 28*a*I (or 28*b*) engages sheet 150 of film 32, while the clamping members 28*a*II (or 28*b*II) engages sheet 152 of film 32. As previously described the pair of clamping members 28*a*I and 28*a*II (as mentioned the following applies to clamping members 28*b*I and 28*b*II) are moved toward the film 32 with each clamping member 28*a*I and 28*a*II being adjacent to a respective sheet 150 and 152. The clamping members 28*a*I and 28*a*II comprise respective clamping or gripping elements 154. The gripping elements 154 include a pair of lip assemblies 156 and 158. The lip assemblies 156 and 158 include respective outer sheets 160 and 162 mounted to an actuator 164 in the area 166 between the lip assemblies 154 and 156. First the gripping sides 154 of each clamping members 28*a*I and 28*a*II engage the sheets 150 and 152 respectively as shown in FIGS. 18A and 18B. Then the actuator 164 retracts into the area 166 pulling the sheets 160 and 162 which suck in a portion of each sheet 150 and 152 as shown in FIG. 18C. Each lip assembly 156 and 158 include respective pressure members 168 and 170 which swell in order to add gripping pressure to the portion of the sucked in sheets 150 and 152 as shown in FIG. 18D. Once the sheets 150 and 152 are firmly gripped, the clamping members 28*a*I and 28*a*II are moved away from one another thereby separating the previously overlapping sheets 150 and 152 as shown in FIG. 18E.

FIGS. 17A to 17B show lip assemblies 256 and 258 which are similar to lip assemblies 156 and 158 except for the configuration of the outer sheets 260 and 262 thereof and hence, FIGS. 17A to 17E require no further description.

The skilled artisan will appreciate that the apparatus 10 also includes sensors (not shown) that can determine the length, width and height of the load. These sensors are in communication with a controller (not shown) such as a computer for example in order to send data thereto. The controller is in communication with the film dispensing and cutting assembly 16, the film conveying device 18 and with the film stretching and bagging device 18 so as to signal the foregoing to operate in a certain way depending on the data received from the sensor or sensors.

It should be noted that the film stretching and bagging device 19 can be installed to a variety of other systems already including the other sub-apparatuses described herein. Therefore in an embodiment, the apparatus 10 may include the film stretching and bagging device 20 only.

The invention will now be described in operation with reference to sequential FIGS. 1 to 9.

FIG. 1 shows a load 12 having been transferred in the +Y direction adjacent to the apparatus 10. A sensor ascertains the length of the load 12 and signals this data to the controller which processes the length of film 32 needed to bag this load 12. As shown, the film 32 has been unrolled from the dispenser 30 and its free end is mounted to the sealing and cutting device 34. The gripping members 39 of the leading lateral clamp 38 grip this free end and convey a predetermined length of this film in the +Y direction as shown in FIG. 2.

Figure 2:
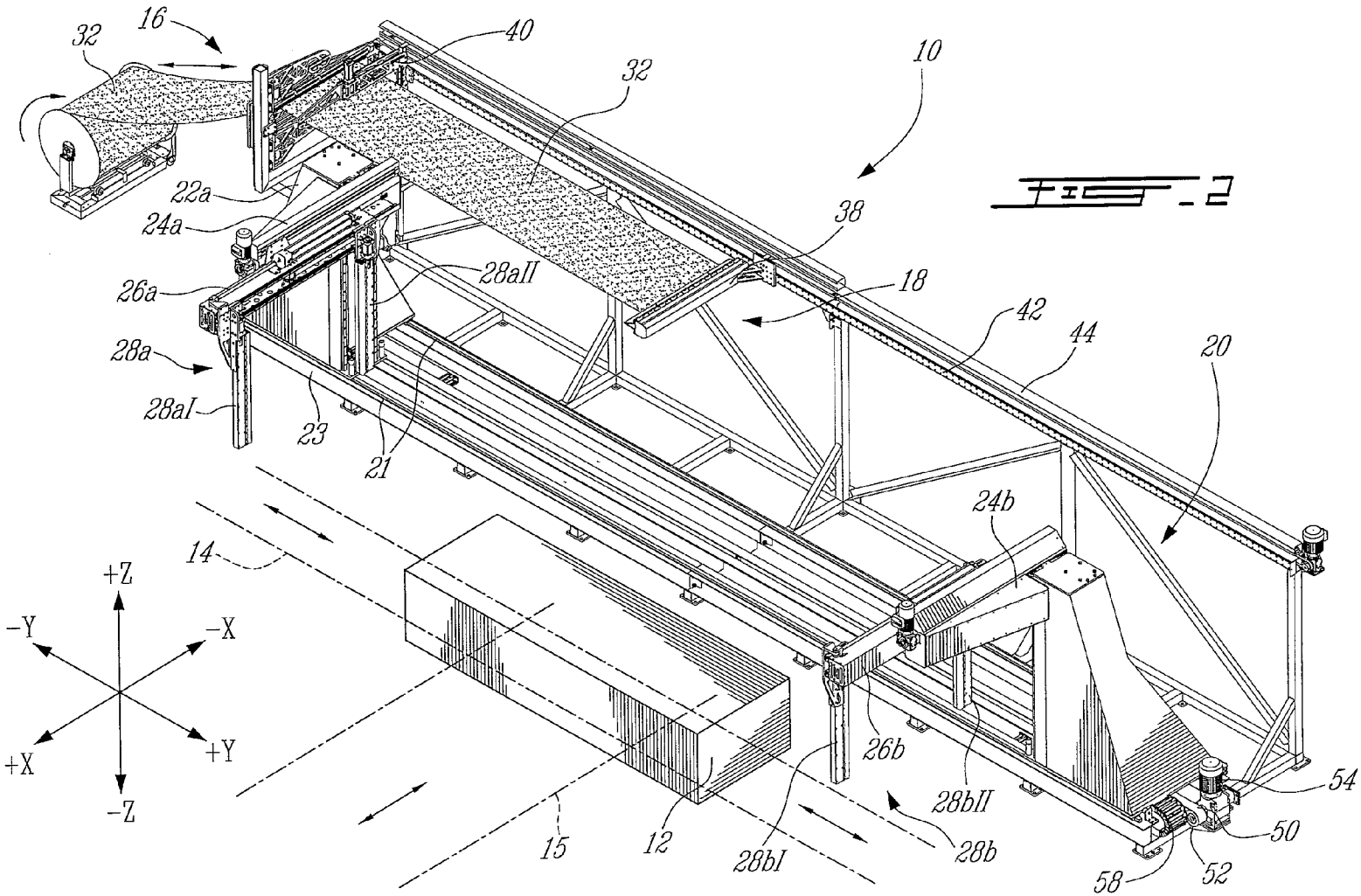
Figure 3:
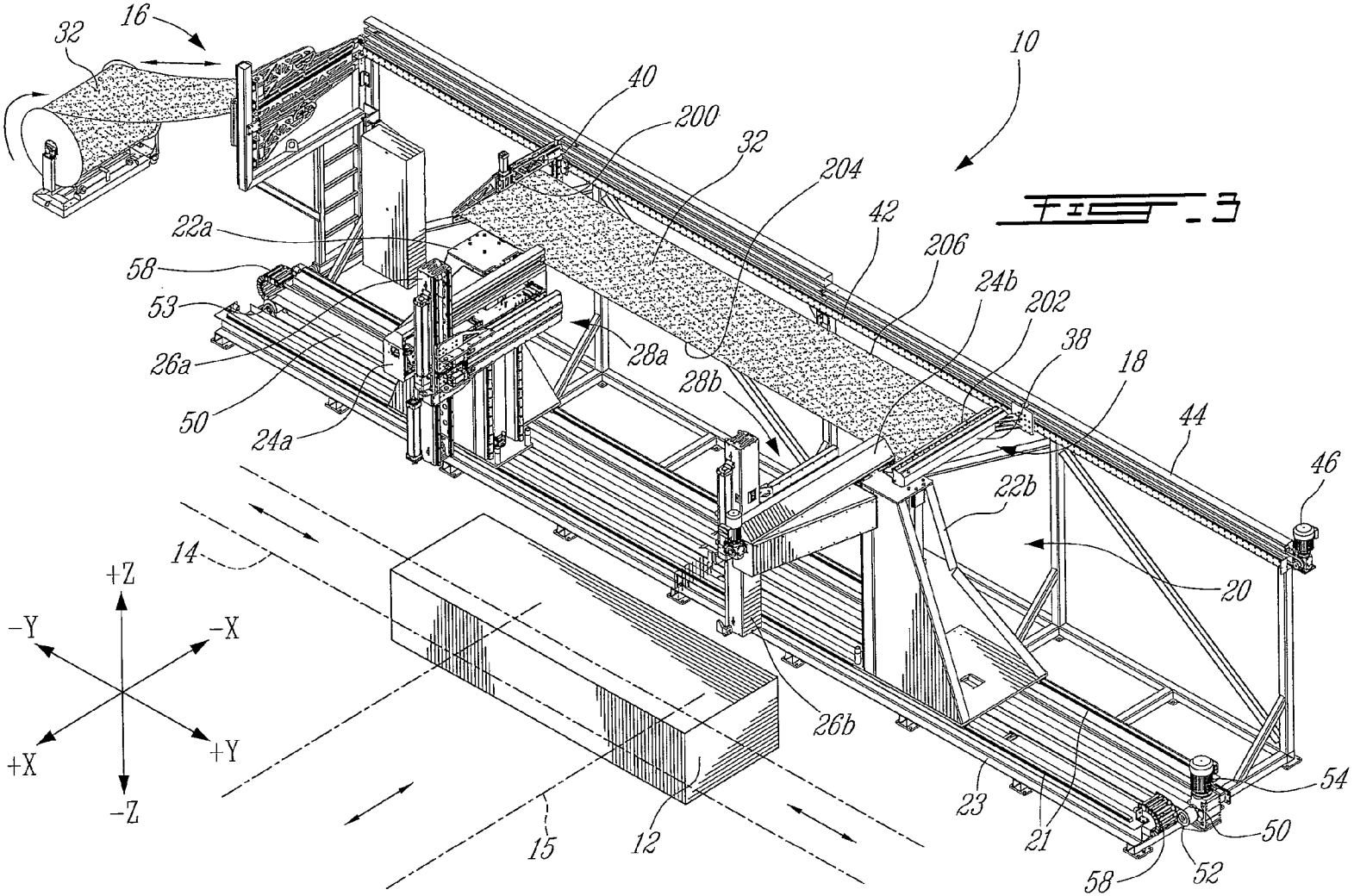

FIG. 2 shows that the floating clamp 40 clamps a longitudinal end of the film 32. The length of the film 32 between the floating clamp 40 and leading lateral clamp 38 is the predetermined length required. The film 32 is sealingly cut by the cutting device 34 and the leading and floating clamps 38 and 40 convey this cut film 32 along the rail 42 as shown in FIG. 3. In this way, the cut film 32 is placed adjacently to the stretching and bagging device 20 with its longitudinal ends 200 and 202 being sealed, the longitudinal edge 204 being a closed edge formed by the folding of the two overlapping sheets 150 and 152 and the opposite edge 206 being open. FIG. 3 also shows that the carriages 22*a* and 22*b* moved on base frame 23 at distance relative to one another that is dependent on the length of the piece of film 32.

Figure 4:
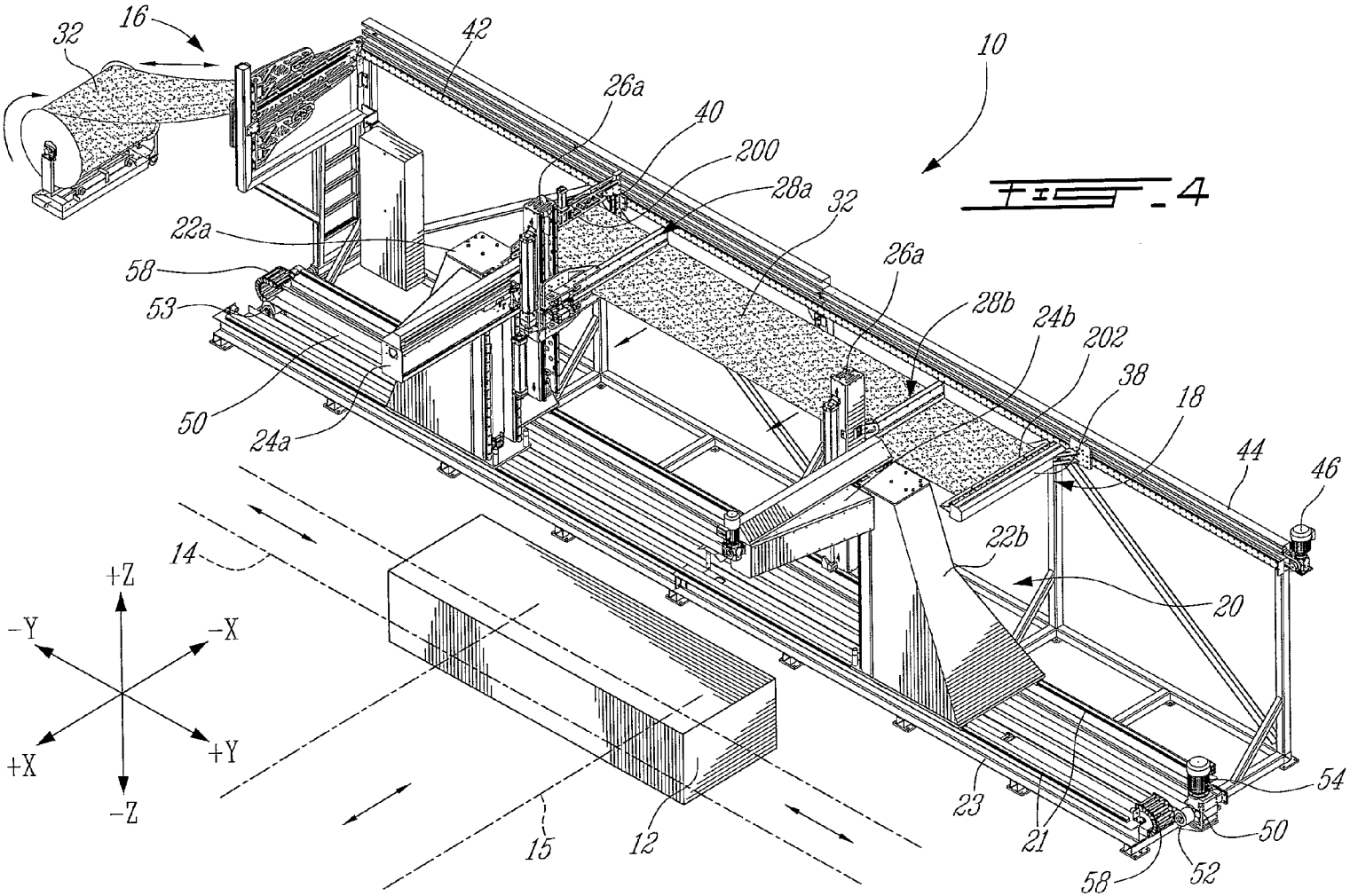

With reference to FIGS. 3 and 4, the mobile arms 26*a* and 26*b* are in the generally vertical position causing the clamp 28*a* and 28*b* to be in the generally horizontal position. The arms 26*a* and 26*b* move in the −X direction along their respective elevator supports 24*a* and 24*b*, approaching the film 32, in tandem the clamps 28*a* and 28*b* open so as to receive the film 32 between their respective clamping members 28*a*I, 28*a*II and 28*b*I, 28*b*II respectively and then close so as to clamp the film 32 near the two opposite longitudinal ends 200 and 202 thereof.

Figure 5:
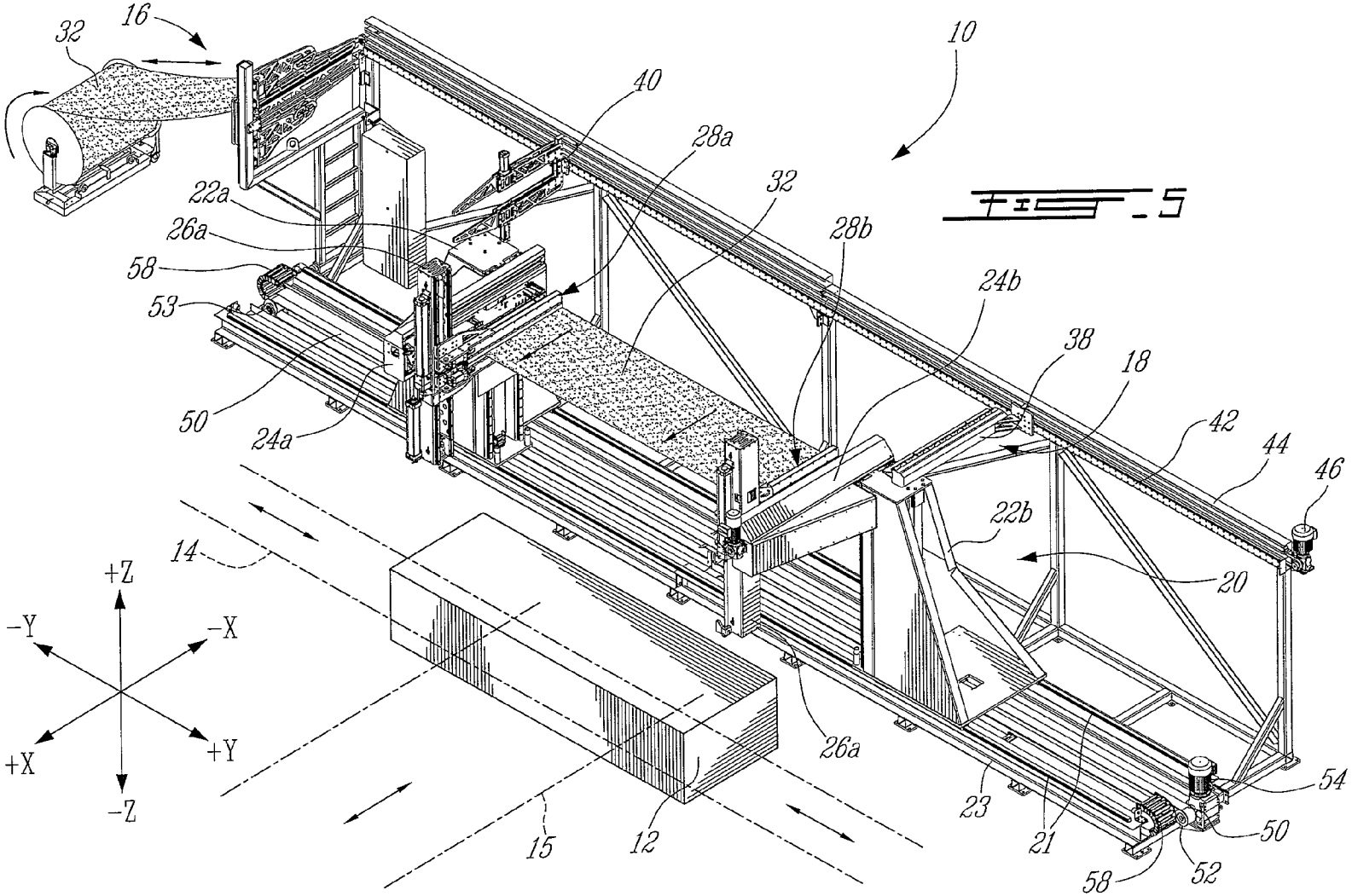

With respect to FIG. 5, the leading lateral and floating clamps 38 and 40 release the film 32 thus allowing the mobile arms 26*a* and 26*b* to move in the +X direction with the horizontal clamps 28*a* and 28*b* moving the film 32 therewith.

Figure 6:
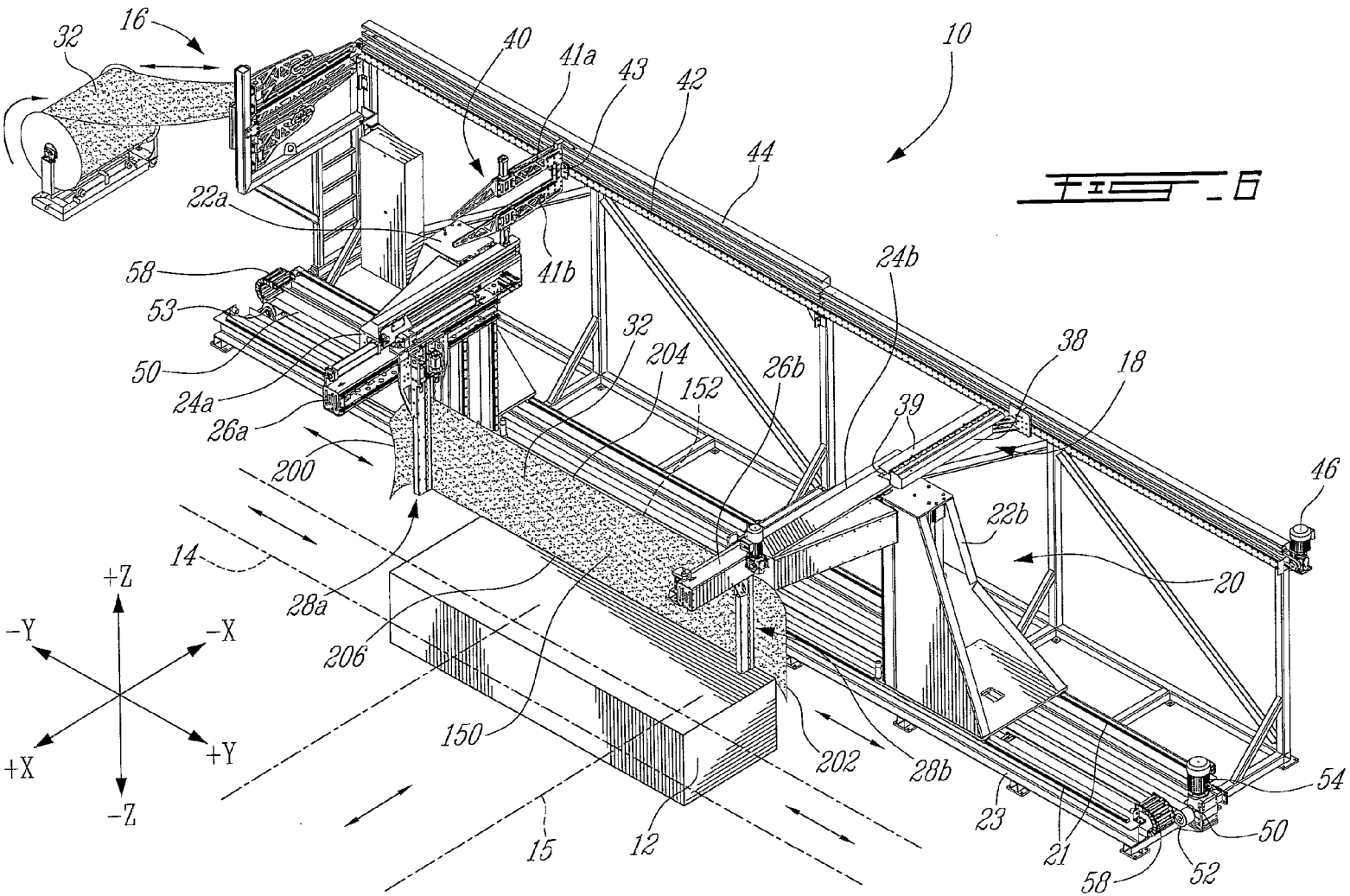

Turning now to FIG. 6, the mobile arms 26*a* and 26*b* are rotated from the generally vertical position to the generally horizontal position causing the clamps 28*a* and 28*b* along with the clamped film 32 to move from the generally horizontal position to the generally vertical position. In this way, the film 32 is placed above the load 12 with its open edge 206 facing the load. The carriages 22*a* and 22*b* are moved away from each other, namely carriage 22*a* is moved in the −Y direction and carriage 22*b* is moved in the +Y direction in order to stretch the film 32. The carriages 22*a* and 22*b* may be moved closer to one another after stretching the film.

Keeping FIGS. 18A-18E and 19A-19E described above in mind, and with reference to FIGS. 6 and 7, each clamping member 28*a*I and 28*b*I clamps or grips a sheet 150 and each clamping member 28*a*II and 28*b*II clamps or grips a sheet 152. The clamps 28*a* and 28*b* are unclamped or opened thereby opening the film 32 above the load 12. More specifically, clamping members 28*a*I and 28*b*I are moved in the +X direction bringing with them the gripped sheet 150 and clamping members 28*a*II and 28*b*II are moved in the −X direction bringing with them the gripped sheet 152. Hence, the film 32 is opened above the load 12.

Figure 7:
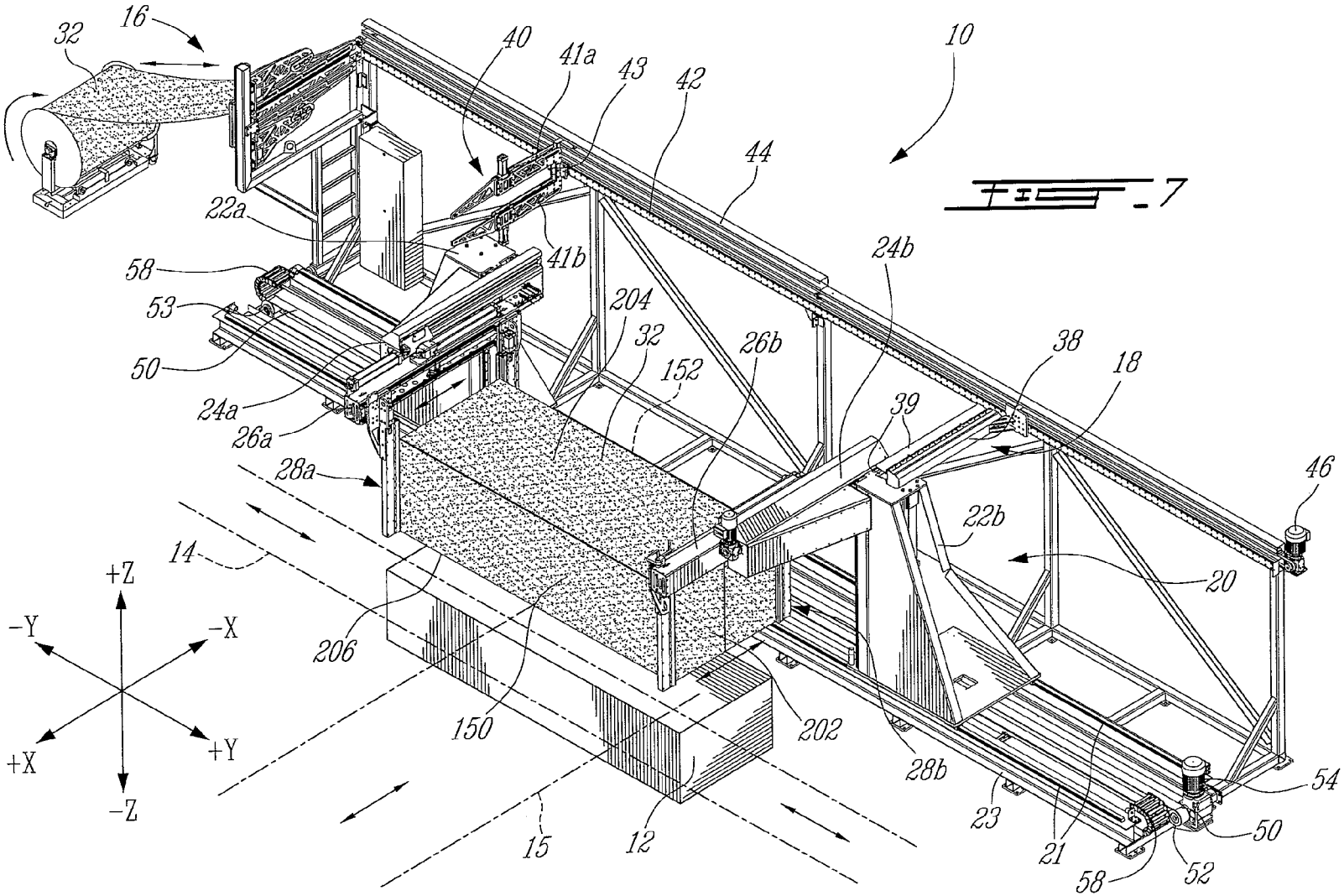
Figure 8:
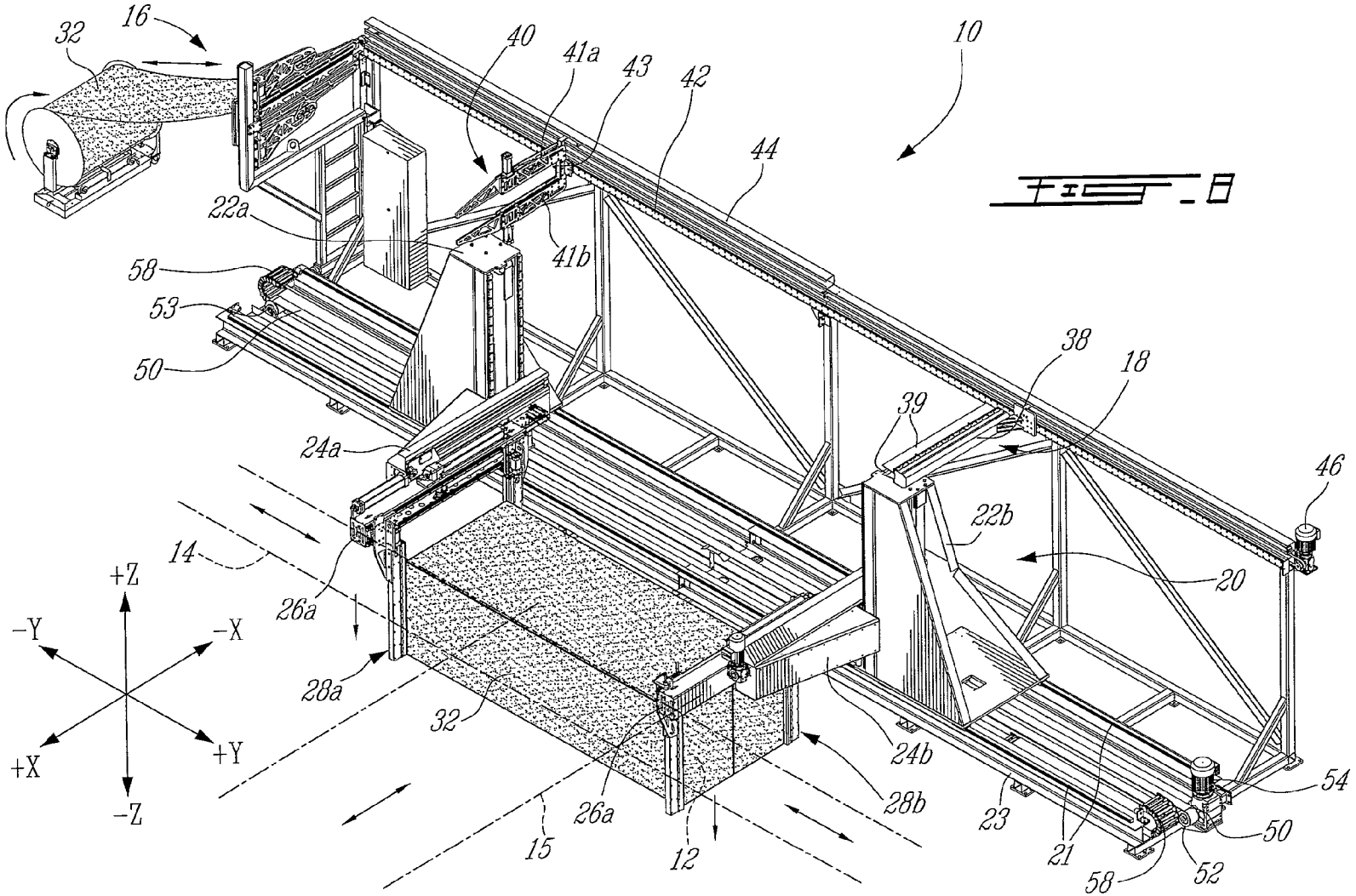

With respect to FIGS. 7 and 8, the elevator supports 24*a* and 24*b* are moved in the −Z direction along their respective carriages 22*a* and 22*b* causing the clamps 28*a* and 28*b* holding the opened film 32 to progressively descend onto the load 12 thereby progressively bagging the load 12 in a gradual and resilient manner.

Figure 9:
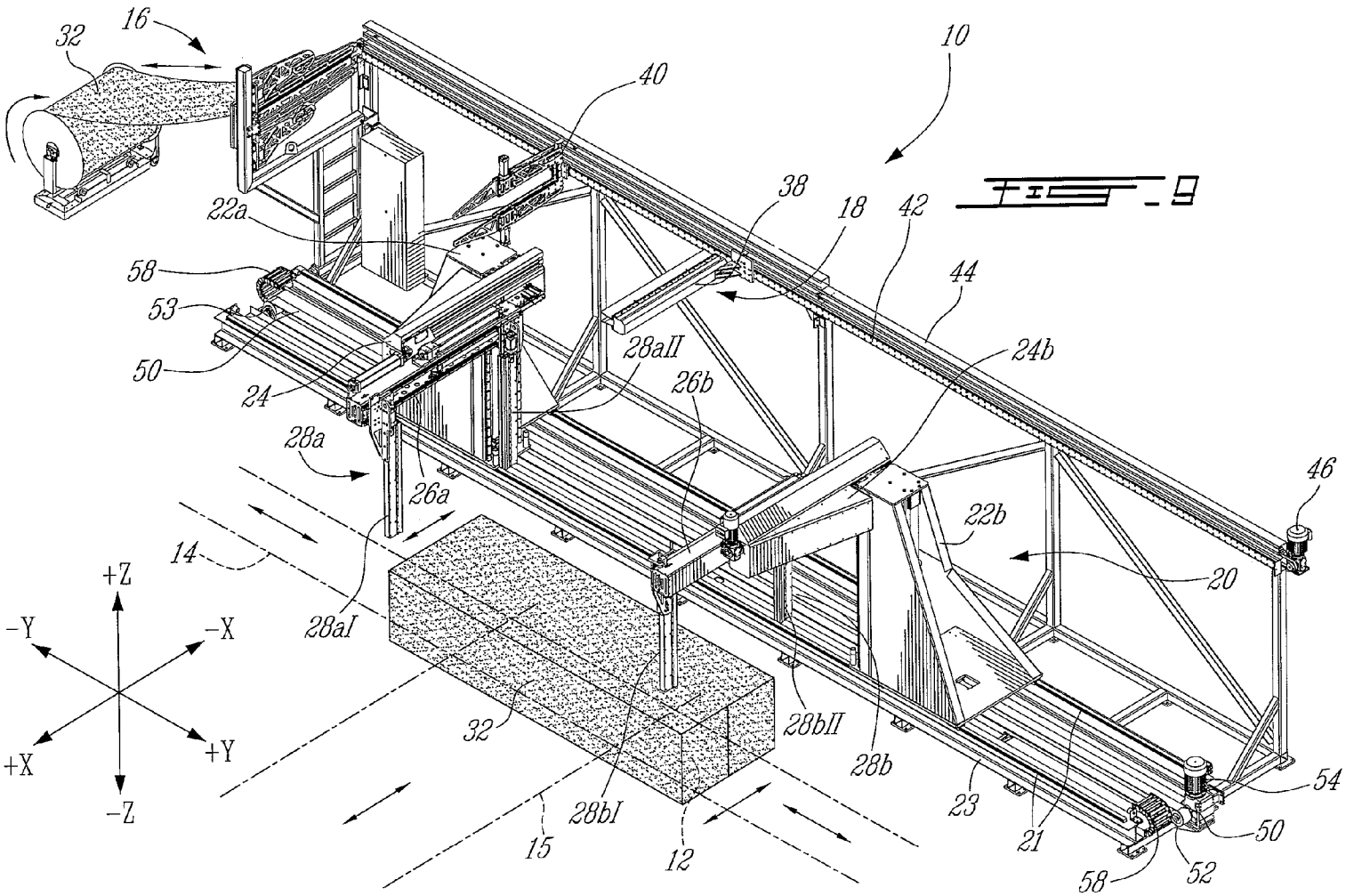

Referring to FIGS. 8 and 9, when the load 12 is fully bagged by the film 32, the clamping members 28*a*I and 28*b*I release sheet 150 and the clamping members 28*a*II and 28*b*II release the sheet 152. The foregoing provides for moving the clamps 28*a* and 28*b* away from the bagged load 12, as the elevator supports 24*a* and 24*b* move in the +Z direction along their respective carriages 22*a* and 22*b*.

The bagged load 12 may then be transferred for shipment via load transfer 15 in the +X direction.

Therefore, the present invention also provides a methods for bagging material. This methods includes the following steps:

(a) providing a desired length of stretchable film, the film having at least two overlapping sheets and at least one open edge.

(b) stretching the desired length of film by clamping the film on the outer surface thereof at two opposite areas, each opposite area being near a respective longitudinal length of the film and moving said these two clamped areas away from one another;

(c) separating the two overlapping sheets by gripping an outer portion of each sheet and moving the gripped outer portions away from one another thereby opening the film; and (d) covering the material by progressively moving the film onto the material while maintaining the gripped outer portions.

The clamp, the mobile arm and the elevator support can also be considered a clamp assembly and may be designed and configured in a variety of ways within the context of the present invention. For example, the clamp assembly can comprise a clamp and a robotic arm mounted to a respective carriage. Other clamp assemblies may include multi-prong clamps having three clamping members or more. In another embodiment, the clamping assembly comprises a clamp as well as any intervening assembly for mounting this clamp to a carriage within the scope of the invention. The carriages can be provided in a variety of vertical configurations and designs. The skilled artisan can contemplate various actuator assemblies for imparting movement to the various components described herein within the context of the present invention.

Figure 20:
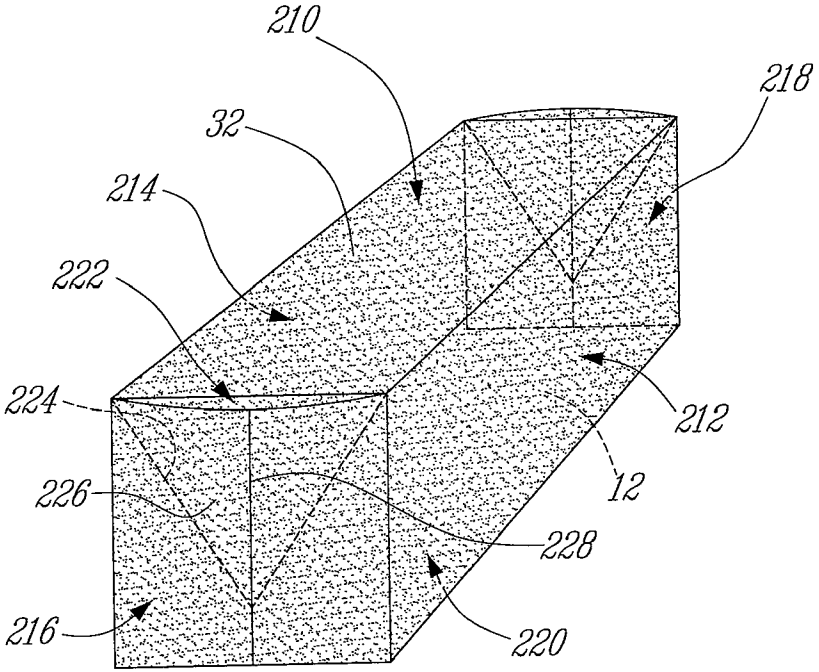
FIG. 20 is a perspective view of a bundle of material bagged, covered or wrapped with a film in accordance with an illustrative embodiment the present invention.

FIG. 20 shows one possible bagging of a load 12 with stretchable film 32 in accordance with an embodiment of the present invention. The film 32 covers load 12 on the top side 210, lateral sides 212 and 214 and front and rear sides 216 and 218, respectively, of the load 12 with the bottom side 220 being left uncovered. At the front and rear sides 216 and 218 the film 32 forms pockets 222 with a generally triangular inner side 224. The pocket 222 has an outer side 226 that is seamed at the middle 228.

Figure 21:
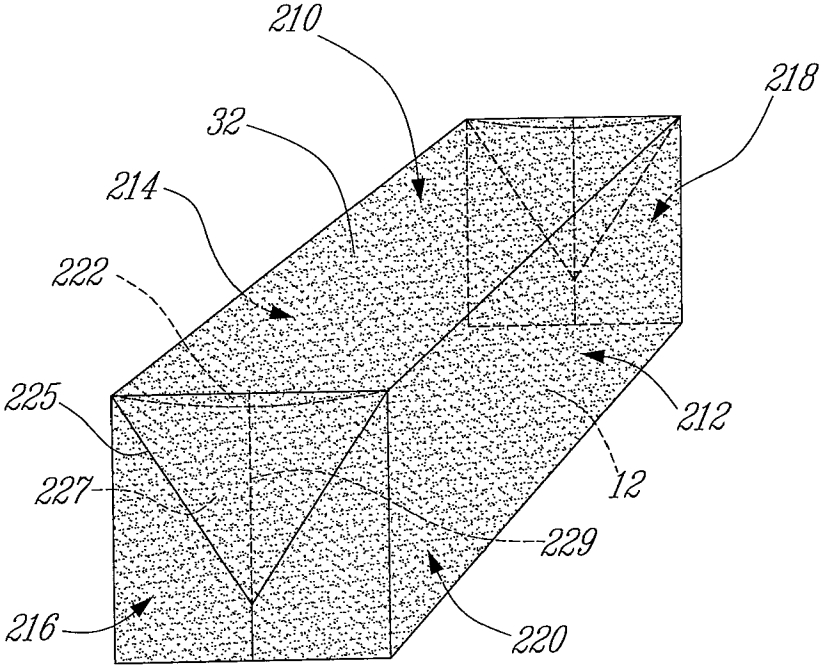
FIG. 21 is a perspective view of a bundle of material bagged, covered or wrapped with a film in accordance with another illustrative embodiment the present invention.

FIG. 21 shows a bagging of load 12 in accordance with another embodiment of the present invention. In FIG. 21, the film 32 is the inverted version of FIG. 20. As such, the triangular inner side 224 of FIG. 20 is now a triangular outer side 225, the outer side 226 of FIG. 20 is now an inner side 227 and the middle seam 228 of FIG. 20 is now an inner middle seam 229.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. An apparatus for bagging material into a film, the film having at least two overlapping sheets and at least one open edge, said apparatus comprising:

a pair of spaced apart carriages; and a pair of clamp assemblies, each said clamp assembly being movably mounted to a respective said carriage so as to be pivotally movable relative to said respective carriage and vertically moveable along the length of said respective carrige, each said clamp assembly comprising a clamp and a mobile arm, each said clamp comprising a respective pair of clamping members being reciprocally movable from a clamping position for engaging the film to an unclamping position, said clamping members being moveably mounted on said mobile arm so as to reciprocally transversely move along the length of said mobile arm, wherein said clamp assemblies engage the film and are configured to open the film by separating the overlapping sheets, said clamp assemblies being downwardly movable along the length of said respective carriages so as to provide for the opened film to progressively bag material positioned thereunder.

2. An apparatus according to claim 1, wherein when said clamping members engage the film, movement of said clamping members to said unclamping position causes separation of the overlapping sheets thereby opening the film.

3. An apparatus according to claim 2, wherein each said clamping member comprises respective gripping elements for gripping a sheet of the film.

4. An apparatus according to claim 3, wherein said clamping members engage the film from the external surface thereof, each said clamping member of a given said clamp engages a respective overlapping sheet.

5. An apparatus according to claim 4, wherein said gripping elements of each said clamping member grips a portion of a respective sheet.

6. An apparatus according to claim 5, wherein when said clamping elements of each given said clamp are moved in said unclamping position thereby separating the sheets from one another.

7. An apparatus according to claim 1, wherein said mobile arm is rotatable relative to said carriage.

8. An apparatus according to claim 1, wherein said mobile arm is mounted to a support, said support being mounted to said carrige.

9. An apparatus according to claim 8, wherein said mobile arm is transversely movable along the longitudinal length of said support.

10. An apparatus according to claim 8, wherein said mobile arm is pivotally mounted to said support.

11. An apparatus according to claim 8, wherein said support comprises an elevator support, said elevator support being moveably mounted to said carriage for moving along the vertical length of said carriage.

12. An apparatus according to claim 11, wherein said mobile arm is pivotally mounted to said elevator support.

13. An apparatus according to claim 11, wherein said mobile arm is transversely movable along the longitudinal length of said elevator support.

14. An apparatus according to claim 13, wherein said mobile arm is pivotally mounted to said elevator support.

15. An apparatus according to claim 1, wherein said mobile arm is transversely movable relative to said carriage.

16. An apparatus according to claim 1, further comprising a film dispensing and cutting assembly.

17. An apparatus according to claim 16, wherein said film dispensing and cutting assembly comprises a sealing and cutting unit for sealingly cutting the film and a selected longitudinal end.

18. An apparatus according to claim 1, further comprising a controller linked to said carriages and said clamp assemblies for transmitting data thereto and comprising a sensor for assessing the size of the material to be bagged.

19. An apparatus for bagging material into a film, the film having at least two overlapping sheets and at least one open edge, said apparatus comprising:

a pair of spaced apart carriages, said carriages being movable relative to one another so as to be brought closer together or moved further away from one another, and a pair of clamp assemblies, each said clamp assembly being movably mounted to a respective said carriage so as to be pivotally movable relative to said respective carriage and vertically moveable along the length of said respective carriage, wherein said clamp assemblies engage the film and are configured to open the film by separating the overlapping sheets, said clamp assemblies being downwardly movable along the length of said respective carriages so as to provide for the opened film to progressively bag material positioned thereunder.

20. An apparatus according to claim 19, wherein said movement of said carriages provides for stretching the film when engaged by said clamp assemblies.

21. An apparatus according to claim 19, wherein said carriages are movably positioned on a rail.

22. An apparatus according to claim 21, further comprising a load transfer for loading and unloading material to be bagged, said load transfer being adjacently positioned relative to said rail.

23. An apparatus according to claim 22, wherein said clamps are so moveable as to be placed above said material on said load transfer.

24. An apparatus for bagging material into a film, the film having at least two overlapping sheets and at least one open edge, said apparatus comprising:

a pair of spaced apart carriages;

a pair of clamp assemblies, each said clamp assembly being movably mounted to a respective said carriage so as to be pivotally movable relative to said respective carriage and vertically moveable along the length of said respective carriage; and a film conveying device for conveying the film to a position adjacent to said carriages, said film conveying device comprising a lateral clamp movably mounted on a lateral rail, said lateral rail being adjacent to said carriages, said lateral clamp configured to clamp a free end of the film and move along said lateral rail thereby conveying the film to a position adjacent to said carriages, wherein said clamp assemblies engage the film and are configured to open the film by separating the overlapping sheets, said clamp assemblies being downwardly movable along the length of said respective carriages so as to provide for the opened film to progressively bag material positioned thereunder.

25. An apparatus according to claim 24, wherein said film conveying device comprises a floating clamp for engaging an end of the film opposite the free end engaged by said lateral clamp, said floating clamp being movable on said lateral rail.

26. An apparatus for bagging material into a film, the film having at least two overlapping bagging sheets and at least one open edge, said apparatus comprising:

a pair of spaced apart carriages; and a pair of clamp assemblies, each said clamp assembly being mounted to a respective carriage and comprising a respective clamp, each said clamp comprising a respective pair of clamping members being reciprocally movable from a clamping position for engaging the film to an unclamping position, each said clamping member comprising a respective pair of retractable gripping sheets for gripping a bagging sheet of the film, wherein when said clamping members engage the film from the external surface thereof, each said clamping member of a given said clamp engages a respective overlapping bagging sheet, said gripping sheets of each said clamping member grip a portion of a respective bagging sheet by retracting thereby pulling a portion of the bagging sheet therebetween, said clamping members of each given said clamp are moved in said unclamping position thereby separating the bagging sheets from one another.

27. An apparatus according to claim 26, wherein each said clamp is movable along the vertical length of a respective said carriage.

28. An apparatus according to claim 27, wherein said carriages are movable relative to one another so as to be brought closer together or moved further apart from one another.

29. An apparatus according to claim 26, wherein each said clamp is rotatable relative to a respective said carriage.

30. An apparatus according to claim 26, wherein each said clamp is transversely movable relative to a respective said carriage.

* * * * *